US010675512B2

(12) United States Patent
Corbeil et al.

(10) Patent No.: US 10,675,512 B2
(45) Date of Patent: Jun. 9, 2020

(54) TECHNOLOGIES FOR A SPORT BALL AND FOR EVALUATION OF HANDLING A SPORT BALL

(71) Applicant: Pacers Basketball, LLC, Indianapolis, IN (US)

(72) Inventors: Josh Corbeil, Greenwood, IN (US); Ninad Trifale, West Lafayette, IN (US); Eric Nauman, West Lafayette, IN (US); Roy Lycke, West Lafayette, IN (US)

(73) Assignee: Pacers Basketball, LLC, Indianapolis, IN (US)

( * ) Notice: Subject to any disclaimer, the term of this patent is extended or adjusted under 35 U.S.C. 154(b) by 0 days.

(21) Appl. No.: 16/142,724

(22) Filed: Sep. 26, 2018

(65) Prior Publication Data

US 2019/0091520 A1 Mar. 28, 2019

Related U.S. Application Data

(60) Provisional application No. 62/563,900, filed on Sep. 27, 2017.

(51) Int. Cl.

| | |
|---|---|
| ***A63B 43/00*** | (2006.01) |
| ***A63B 41/02*** | (2006.01) |
| ***A63B 71/06*** | (2006.01) |
| ***A63B 69/00*** | (2006.01) |
| ***A63B 41/08*** | (2006.01) |
| *A63B 41/00* | (2006.01) |
| *A63B 24/00* | (2006.01) |
| *A63B 67/14* | (2006.01) |

(52) U.S. Cl.

CPC ..... *A63B 43/00* (2013.01); *A63B 41/02* (2013.01); *A63B 41/08* (2013.01); *A63B 43/004* (2013.01); *A63B 69/0071* (2013.01); *A63B 71/06* (2013.01); *A63B 67/14* (2013.01); *A63B 69/002* (2013.01); *A63B 69/0026* (2013.01); *A63B 71/0622* (2013.01); *A63B 71/0669* (2013.01); *A63B 2024/0068* (2013.01); *A63B 2041/005* (2013.01); *A63B 2220/12* (2013.01); *A63B 2220/13* (2013.01); *A63B 2220/51* (2013.01); *A63B 2220/56* (2013.01); *A63B 2220/801* (2013.01); *A63B 2225/50* (2013.01)

(58) Field of Classification Search

None

See application file for complete search history.

(56) References Cited

U.S. PATENT DOCUMENTS 9,257,054 B2 * 2/2016 Coza ..... G09B 19/0038
9,504,414 B2 * 11/2016 Coza ..... G06F 3/011

(Continued)

*Primary Examiner* — Ronald Laneau

(74) *Attorney, Agent, or Firm* — Ice Miller LLP

(57) ABSTRACT

One or more devices, methods, and systems implementing one or more techniques for use of one or more sport balls and/or evaluations of handling one or more sport balls are disclosed. One or more techniques may include a sport ball having one or more pressure sensors configured to generate one or more force values between the one or more pressure sensors and a sport ball user upon use/engagement of the sport ball with the user. One or more techniques may include a processor configured to determine at least one handling value, perhaps based upon the one or more force values.

20 Claims, 21 Drawing Sheets

(56) References Cited

U.S. PATENT DOCUMENTS

| | | | | |
|---|---|---|---|---|
| 2009/0048044 | A1* | 2/2009 | Oleson | A63B 24/0062 473/570 |
| 2015/0328516 | A1* | 11/2015 | Coza | A63B 69/002 473/446 |
| 2018/0117436 | A1* | 5/2018 | Coza | A63B 69/002 |

* cited by examiner

42 {
CATCH VALUE :553
MEAN FORCE :190.6746 MEAN TIME :0.05 FRACTION PAIRED:0.38462

CATCH VALUE :552
MEAN FORCE :199.7404 MEAN TIME :0.05 FRACTION PAIRED:0.375

TECHNOLOGIES FOR A SPORT BALL AND FOR EVALUATION OF HANDLING A SPORT BALL

CROSS-REFERENCE TO RELATED APPLICATIONS

This application claims the benefit of U.S. Provisional Patent Application No. 62/563,900, filed on Sep. 27, 2017, the contents of which being incorporated by reference herein in its entirety, for all purposes.

BACKGROUND

Sporting activities may include handling a ball, such as throwing, catching, passing, rebounding, or otherwise engaging a sport ball by and/or between players, and/or other users. For example, a basketball is passed between players, and proper handling of the basketball improves the ability for the user or the user's team to score. Proper handling of a basketball, soccer ball, or another type of sport ball involves, among other things, practicing proper handling techniques (including, for example, catching, throwing, dribbling, kicking, pitching, etc.).

SUMMARY

The present disclosure includes disclosure of one or more techniques that may be implemented by one or more sport ball systems, devices, and/or methods. In one or more techniques, a sport ball system may include a sport ball having plurality of pressure sensors configured to generate a plurality of force values between the plurality of pressure sensors and a user upon engagement of the sport ball with the user; and a processor configured to determine at least one handling value based upon the plurality of force values. In one or more techniques, a sport ball system may include a transmitter configured to transmit the plurality of force values to base station having the processor. In one or more techniques, the plurality of pressure sensors may include a plurality of diametrically opposed pressure sensors. In one or more techniques, the plurality of pressure sensors may be arranged in a spherical array. In one or more techniques, the processor may be configured to determine the at least one handling value, perhaps for example based upon a time period of generating the plurality of force values.

In one or more techniques, the time value may be based upon a time threshold from a beginning of a user engagement of the sport ball to a completion of the user engagement of the sport ball. In one or more techniques, the time period may include a mean time determined from a beginning of a user engagement with an active sensor to a completion of the user engagement with the active sensor. The active sensor may be a pressure sensor having a diametrically opposed pressure sensor generating a force value. In one or more techniques, the processor may be configured to determine the at least one handling value, perhaps for example based upon an active sensor value based upon a number of diametrically opposed sensors generating force values. In one or more techniques, the active sensor value may be further based upon a total number of pressure sensors generating force values.

One or more techniques may include handling evaluations of a sport ball. One or more techniques may include sensing a plurality of force values between a plurality of pressure sensors of a sport ball and a user. One or more techniques may include determining at least one handling value based upon the plurality of force values. One or more techniques may include transmitting the plurality of force values from the sport ball. One or more techniques may include determining a time value, perhaps for example based upon a time period of generating the plurality of force values. In one or more techniques, determining the at least one handling value may be further based upon the time value. In one or more techniques, the time value may include a time threshold from a beginning of a user engagement of the sport ball to a completion of the user engagement of the sport ball.

In one or more techniques, the time period may include a mean time determined from a beginning of a user engagement with an active sensor to a completion of the user engagement with the active sensor. The active sensor may be a pressure sensor having a diametrically opposed pressure sensor generating a force value. One or more techniques may include determining an active sensor value, perhaps for example based upon a number of diametrically opposed sensors generating force values. In one or more techniques, determining the at least one handling value may be further based upon the active sensor value. In one or more techniques, the active sensor value may be further based upon a total number of pressure sensors generating force values.

One or more techniques may be implemented by a sport ball device. The sport ball device may include an outer surface. The sport ball device may include an inner space. The sport ball device may include one or more sensors. Each of the one or more sensors may be configured to generate one or more force values corresponding to pressure applied to the outer surface. The sport ball device may include a processing module. The processing module may be configured to communicate with the one or more sensors. The processing module may be configured to perform sport ball use analysis using the one or more force values and/or to transmit the one or more force values to a remote processing device.

In one or more techniques, the processing module may be configured to determine at least one handling value corresponding to the pressure applied to the outer surface of the sport ball based, at least in part, on the one or more force values generated by at least one of the one or more sensors.

In one or more techniques, the sport ball device may include at least one counterweight that may be disposed proximate to the inner space, perhaps for example to provide a counterweight effect to at least the processing module.

In one or more techniques, the sport ball device may include at least three counterweights that may be disposed proximate to the inner space, perhaps for example to provide a counterweight effect to at least the processing module.

One or more techniques may perform evaluation of a use of a sport ball. One or more techniques may include generating one or more force values by one or more sensors that may be disposed on the sport ball. The one or more force values may correspond to pressure applied to an outer surface of the sport ball. One or more techniques may include transmitting the one or more force values to a remote processing device. One or more techniques may include performing sport ball use analysis using the one or more force values at the remote processing device.

One or more techniques may include recognizing, by the remote processing device, that at least two of the one or more sensors are paired. The sport ball use analysis may include determining a grip event, for example based, at least in part, on the one or more force values respectively generated by each of the at least two paired sensors. The at least two paired sensors may include a first sensor and a second sensor. The sport ball use analysis may further include determining a timing difference between an activation of the first sensor and an activation of the second sensor. The sport ball use analysis may further include determining a grip score, for example based, at least in part, on the timing difference.

BRIEF DESCRIPTION OF THE DRAWINGS

The features, elements, devices, systems, methods, advantages, and disclosures contained herein, and the manner of attaining them, will become apparent and the present disclosure will be better understood by reference to the following description of various examples of the present disclosure taken in conjunction with the accompanying drawings, wherein.

DETAILED DESCRIPTION

Figure 1:
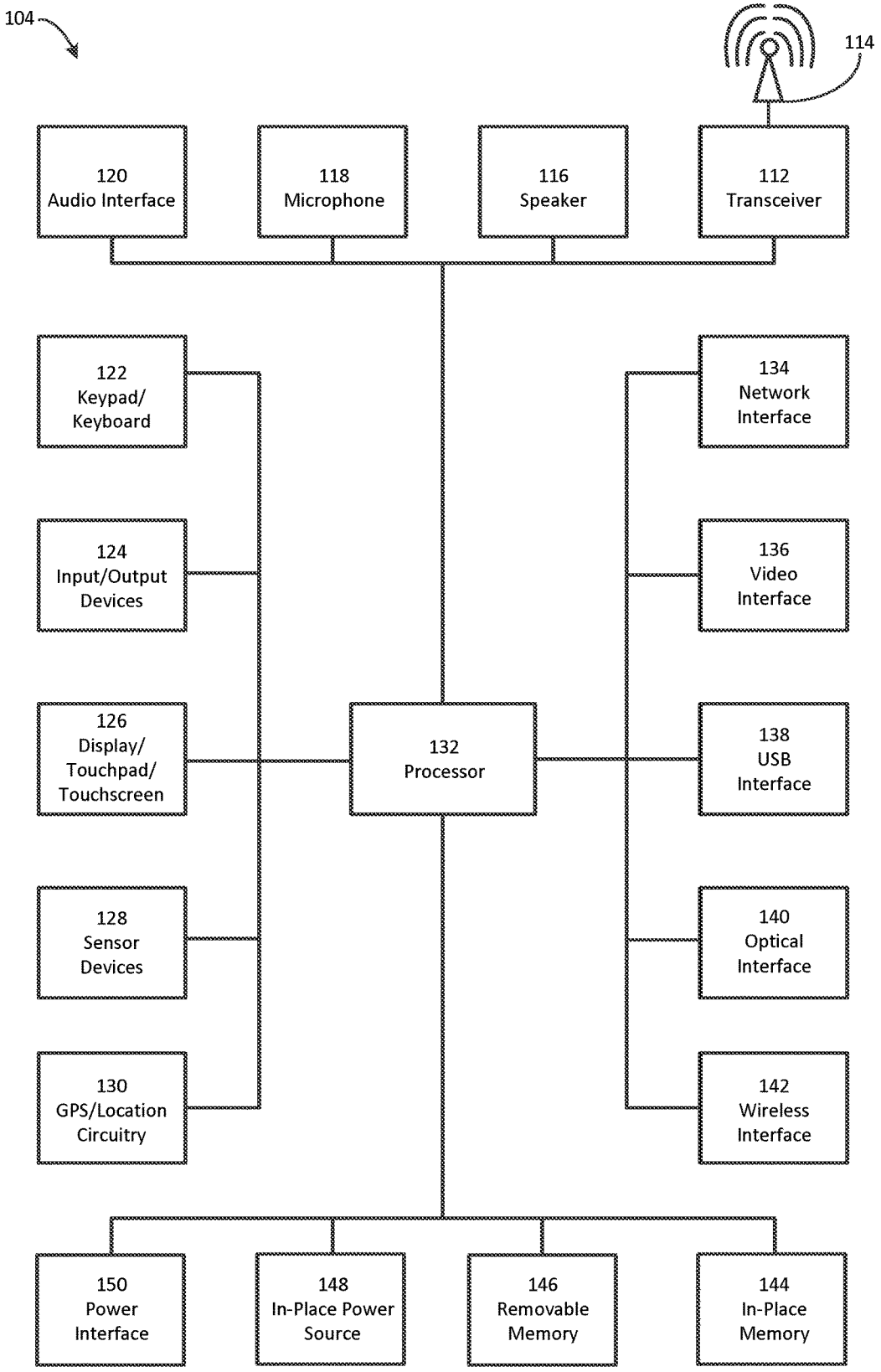
FIG. 1 is an example diagram of a computer/processing device wherein one or more of the techniques of the disclosure may be implemented.

For the purposes of promoting an understanding of the principles of the present disclosure, reference will now be made to one or more examples illustrated in the drawings, and specific language will be used to describe the same. No limitation of the scope of this disclosure is thereby intended.

Conventional catching and/or handling evaluation techniques do not qualitatively evaluate the catching and/or handling of a sport ball by a user. One or more techniques of evaluating handling of a sport ball, such that the handling of the sport ball by a user may be determined qualitatively may be useful. A sport ball that supports the qualitative determination of the sports ball's handling by a user may be useful.

FIG. 1 is a diagram of an example computer/computing (e.g., processing) device 104 that may implement one or more techniques described herein, in whole or at least in part, with respect to one or more of the devices, methods, and/or systems described herein. In FIG. 1, the computing device 104 may include one or more of: a processor 132, a transceiver 112, a transmit/receive element (e.g., antenna) 114, a speaker 116, a microphone 118, an audio interface (e.g., earphone interface and/or audio cable receptacle) 120, a keypad/keyboard 122, one or more input/output devices 124, a display/touchpad/touch screen 126, one or more sensor devices 128, Global Positioning System (GPS)/location circuitry 130, a network interface 134, a video interface 136, a Universal Serial Bus (USB) Interface 138, an optical interface 140, a wireless interface 142, in-place (e.g., non-removable) memory 144, removable memory 146, an in-place (e.g., removable or non-removable) power source 148, and/or a power interface 150 (e.g., power/data cable receptacle). The computing device 104 may include one or more, or any sub-combination, of the aforementioned elements.

The computing device 104 may take the form of a laptop computer, a desktop computer, a computer mainframe, a server, a terminal, a tablet, a smartphone, and/or a cloud-based computing device (e.g., at least partially), and/or the like.

The processor 132 may be a general-purpose processor, a special-purpose processor, a conventional processor, a digital-signal processor (DSP), a plurality of microprocessors, one or more microprocessors in association with a DSP core, a controller, a microcontroller, one or more Application Specific Integrated Circuits (ASICs), one or more Field Programmable Gate Array (FPGAs) circuits, any other type of integrated circuit (IC), and/or a finite-state machine, and/or the like. The processor 132 may perform signal coding, data processing, power control, sensor control, interface control, video control, audio control, input/output processing, and/or any other functionality that enables the computing device 104 to serve as and/or perform as (e.g., at least partially) one or more of the devices, methods, and/or systems disclosed herein.

The processor 132 may be connected to the transceiver 112, which may be connected to the transmit/receive element 124. The processor 132 and the transceiver 112 may operate as connected separate components (as shown). The processor 132 and the transceiver 112 may be integrated together in an electronic package or chip (not shown).

The transmit/receive element 114 may be configured to transmit signals to, and/or receive signals from, one or more wireless transmit/receive sources (not shown). For example, the transmit/receive element 114 may be an antenna configured to transmit and/or receive RF signals. The transmit/receive element 114 may be an emitter/detector configured to transmit and/or receive IR, UV, or visible light signals, for example. The transmit/receive element 114 may be configured to transmit and/or receive RF and/or light signals. The transmit/receive element 114 may be configured to transmit and/or receive any combination of wireless signals.

Although the transmit/receive element 114 is shown as a single element, the computing device 104 may include any number of transmit/receive elements 114 (e.g., the same as for any of the elements 112-150). The computing device 104 may employ Multiple-Input and Multiple-Output (MIMO) technology. For example, the computing device 104 may include two or more transmit/receive elements 114 for transmitting and/or receiving wireless signals.

The transceiver 112 may be configured to modulate the signals that are to be transmitted by the transmit/receive element 114 and/or to demodulate the signals that are received by the transmit/receive element 114. The transceiver 112 may include multiple transceivers for enabling the computing device 104 to communicate via one or more, or multiple, radio access technologies, such as Universal Terrestrial Radio Access (UTRA), Evolved UTRA (E-UTRA), and/or IEEE 802.11, for example.

The processor 132 may be connected to, may receive user input data from, and/or may send (e.g., as output) user data to: the speaker 116, microphone 118, the keypad/keyboard 122, and/or the display/touchpad/touchscreen 126 (e.g., a liquid crystal display (LCD) display unit or organic light-emitting diode (OLED) display unit, among others). The processor 132 may retrieve information/data from and/or store information/data in, any type of suitable memory, such as the in-place memory 144 and/or the removable memory 146. The in-place memory 144 may include random-access memory (RAM), read-only memory (ROM), a register, cache memory, semiconductor memory devices, and/or a hard disk, and/or any other type of memory storage device.

The removable memory 146 may include a subscriber identity module (SIM) card, a portable hard drive, a memory stick, and/or a secure digital (SD) memory card, and/or the like. The processor 132 may retrieve information/data from, and/or store information/data in, memory that might not be physically located on the computing device 104, such as on a server, the cloud, and/or a home computer (not shown).

One or more of the elements 112-146 may receive power from the in-place power source 148. In-place power source 148 may be configured to distribute and/or control the power to one or more of the elements 112-146 of the computing device 104. The in-place power source 148 may be any suitable device for powering the computing device 104. For example, the in-place power source 148 may include one or more dry cell batteries (e.g., nickel-cadmium (NiCd), nickel-zinc (NiZn), nickel metal hydride (NIMH), lithium-ion (Li-ion), etc.), solar cells, and/or fuel cells, and/or the like.

Power interface 150 may include a receptacle and/or a power adapter (e.g., transformer, regulator, and/or rectifier) that may receive externally sourced power via one or more AC and/or DC power cables, and/or via wireless power transmission. Any power received via power interface 150 may energize one or more of the elements 112-146 of computing device 104, perhaps for example exclusively or in parallel with in-place power source 148. Any power received via power interface 150 may be used to charge in-place power source 148.

The processor 132 may be connected to the GPS/location circuitry 130, which may be configured to provide location information (e.g., longitude and/or latitude) regarding the current location of the computing device 104. The computing device 104 may acquire location information by way of any suitable location-determination technique.

The processor 132 may be connected to the one or more input/output devices 124, which may include one or more software and/or hardware modules that provide additional features, functionality and/or wired and/or wireless connectivity. For example, the one or more input/output devices 124 may include a digital camera (e.g., for photographs and/or video), a hands free headset, a digital music player, a media player, a frequency modulated (FM) radio unit, an Internet browser, and/or a video game player module, and/or the like.

The processor 132 may be connected to the one or more sensor devices 128, which may include one or more software and/or hardware modules that provide additional features, functionality and/or wired and/or wireless connectivity. For example, the one or more sensor devices 128 may include an accelerometer, an e-compass, and/or a vibration device, and/or the like.

The processor 132 may be connected to the network interface 134, which may include one or more software and/or hardware modules that provide additional features, functionality and/or wireless and/or wired connectivity. For example, the network interface 134 may include a Network Interface Controller (NIC) module, a Local Area Network (LAN) module, an Ethernet module, a Physical Network Interface (PNI) module, and/or an IEEE 802 module, and/or the like.

The processor 132 may be connected to the video interface 136, which may include one or more software and/or hardware modules that provide additional features, functionality and/or wired and/or wireless connectivity. For example, the video interface 136 may include a High-Definition Multimedia Interface (HDMI) module, a Digital Visual Interface (DVI) module, a Super Video Graphics Array (SVGA) module, and/or a Video Graphics Array (VGA) module, and/or the like.

The processor 132 may be connected to the USB interface 138, which may include one or more software and/or hardware modules that provide additional features, functionality and/or wired and/or wireless connectivity. For example, the USB interface 138 may include a universal serial bus (USB) port, and/or the like.

The processor 132 may be connected to the optical interface 140, which may include one or more software and/or hardware modules that provide additional features, functionality and/or wired and/or wireless connectivity. For example, the optical interface 140 may include a read/write Compact Disc module, a read/write Digital Versatile Disc (DVD) module, and/or a read/write Blu-Ray™ disc module, and/or the like.

The processor 132 may be connected to the wireless interface 142, which may include one or more software and/or hardware modules that provide additional features, functionality and/or wireless connectivity. For example, the wireless interface 142 may include a Bluetooth® module, an Ultra-Wideband (UWB) module, a ZigBee module, and/or a Wi-Fi (IEEE 802.11) module, and/or the like.

Figure 2:
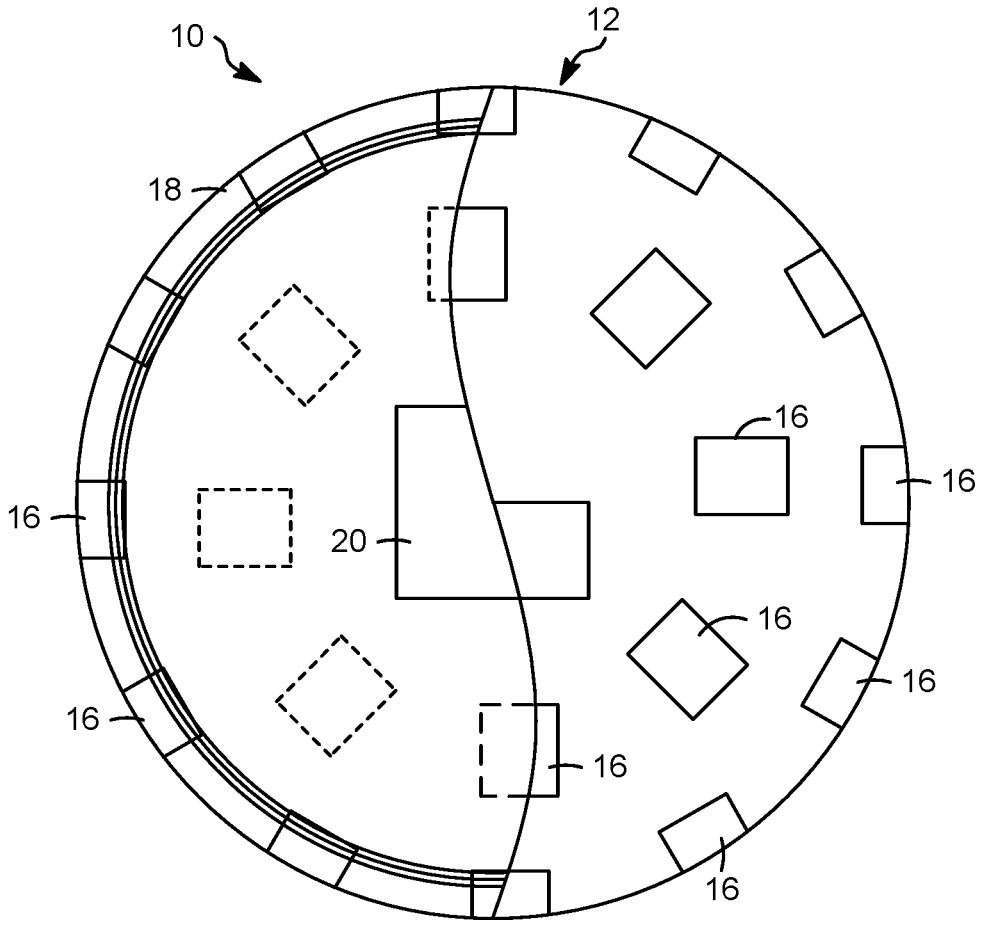
FIG. 2 illustrates an example partial cross-sectional schematic view of a sport ball.

FIG. 2 illustrates an example schematic of a sport ball. The sport ball 12 of FIG. 2 may be a basketball. In one or more techniques, any ball, disk, puck, and/or other object may be used as the sport ball 12. The sport ball 12 may include one or more, or a plurality, of pressure sensors 16 disposed on and/or adjacent to an outer surface/layer/skin 18 of the sport ball 12. One or more of the plurality of pressure sensors 16 may be force sensors. In one or more techniques, one or more of the plurality of pressure sensors 16 may be disposed below an outer layer/skin or grip surface (not shown) of the sport ball 12. In one or more techniques, one or more of the plurality of pressure sensors 16 may form at least a part of the outer surface/layer/skin 18. One or more of the plurality of pressure sensors 16 may be disposed at any depth along the outer surface/skin/layer 18 of the sport ball 12, perhaps for example as long as the one or more of the plurality of pressure sensors 16 are capable of detecting contact, pressure, and/or other force (e.g., proximately and/or immediately) adjacent the one or more pressure sensors 16. For example, one or more of the plurality of pressure sensors 16 may be disposed within a depth of 10 millimeters within the outer surface/skin/layer 18 of the sport ball 12. For example, an outer surface/layer/skin of any of the sport balls described herein may have an external side and/or an internal side (not shown). In one or more techniques, the external side may be the grip surface. In one or more techniques, one or more of the plurality of pressure sensors 16 may be disposed within a depth of 10 millimeters from an external side of the outer surface/layer/skin.

Figure 3:
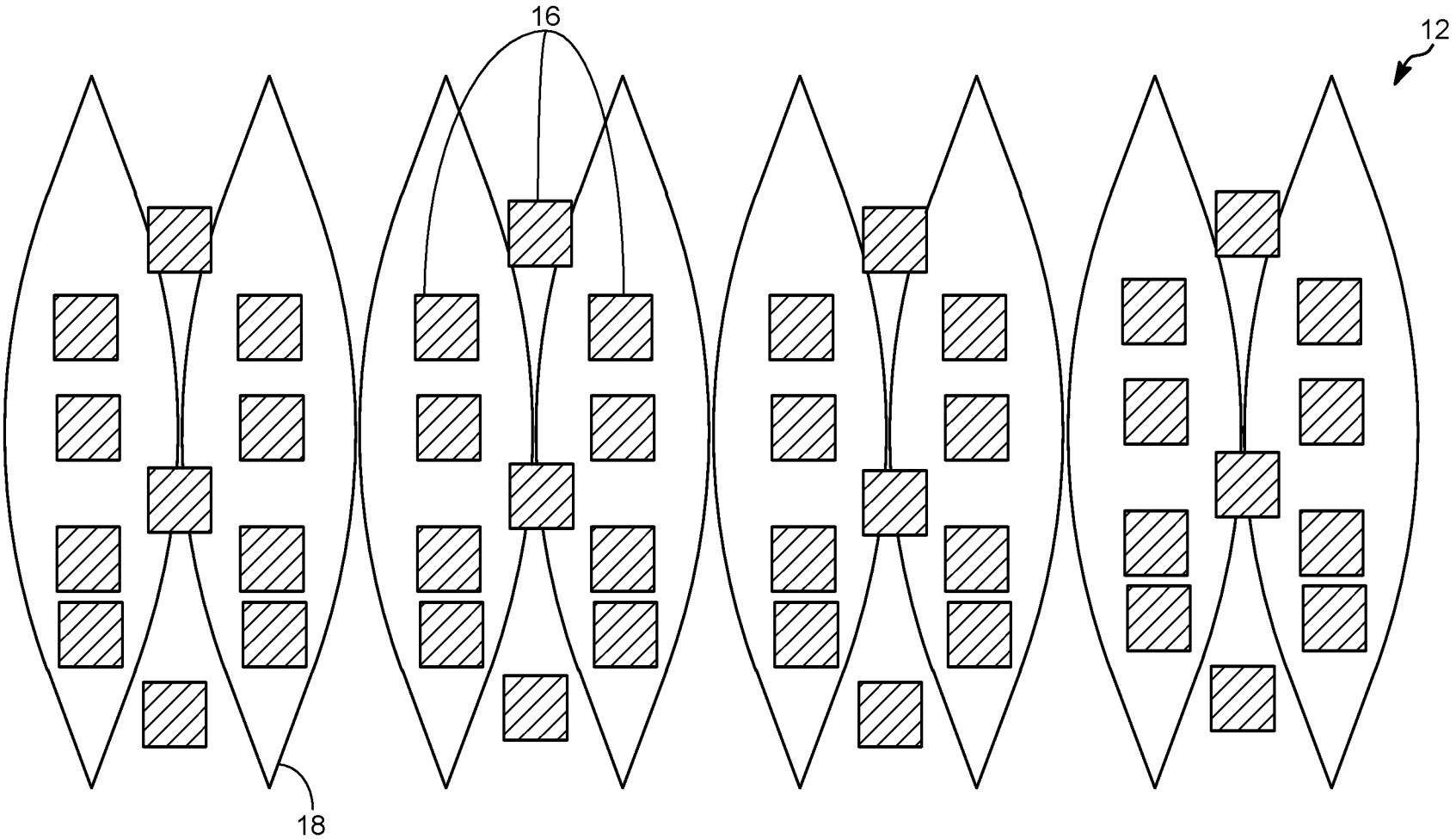
FIG. 3 illustrates an example sphere gore pattern of a pressure sensor array on an outer surface of a sport ball.

FIG. 3 illustrates an example pattern of a plurality of pressure sensors 16 (e.g., a sensor array) on the sport ball 12. In FIG. 3, the outer surface/layer/skin 18 of the sport ball 12 is illustrated by a sphere gore method to show distribution of one or more of the plurality of pressure sensors 16. For example, one or more of the plurality of pressure sensors 16 may be resistive (fixe and/or variable sized) force sensors, among other type of sensors that may be used to measure and/or derive pressure. The example pattern illustrated in FIG. 3 includes forty-four (44) pressure sensors 16 arranged in a spherical array. In one or more techniques, more than forty-four pressure sensors 16, or less than forty-four pressure sensors 16, may be utilized. One or more of the plurality of pressure sensors 16 may be disposed at different positions and/or in accordance with any other pattern. Two or more, or each, pressure sensor 16 may be paired to another, perhaps diametrically opposed pressure sensor 16, to form one or more sensor pairs. For example, if each of the 44 pressure sensors 16 are paired with a respective diametrically positioned pressure sensor 16, then twenty-two (22) pressure sensor 16 pairs may be formed (not shown). Such sensor pairs (e.g., 22 pressure sensor pairs) may contribute to sport ball 12 handling evaluation(s) as described herein.

Figure 4:
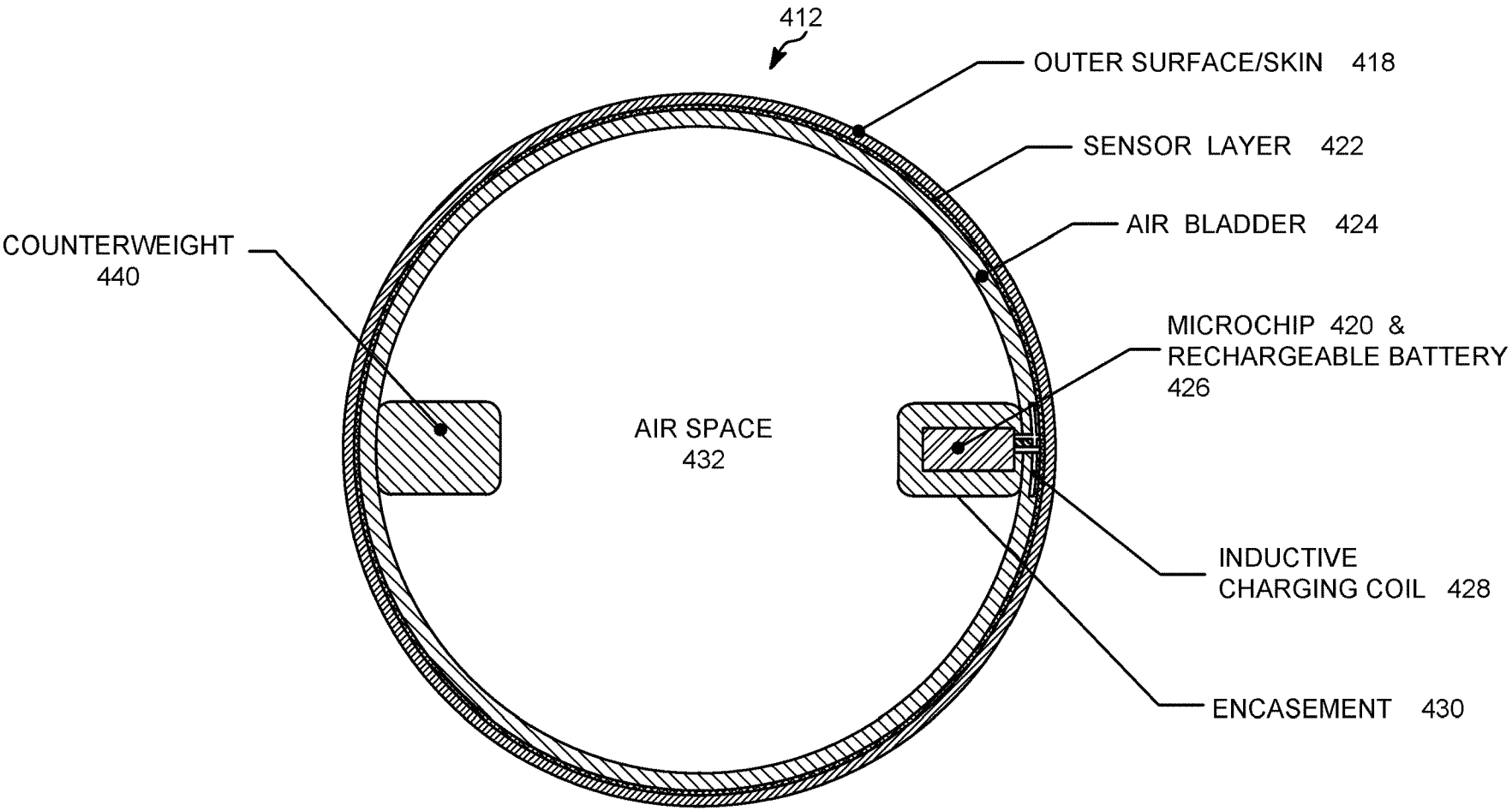
FIG. 4 illustrates an example partial cross-sectional schematic view of a sport ball.

FIG. 4 illustrates an example illustration of a partial cross-section of a sport ball. The sport ball 412 of FIG. 4 may be a basketball. In one or more techniques, any ball, disk, puck, and/or other object may be used as the sport ball 412. The sport ball 412 may include a sensor layer 422 disposed under and/or adjacent to an outer surface/skin/layer 418 of the sport ball 412. The sport ball 412 may include an air bladder 424, perhaps for example constructed of rubber or a like material. The air bladder 424 may encapsulate an air space 432, or whatever other suitable gas that may be used to inflate the air bladder 424. The sport ball 412 may include a microchip/internal module/processor 420. The sport ball 412 may include a rechargeable battery 426. The sport ball 412 may include an inductive charging coil 428 that may be used to charge/recharge the rechargeable battery 426 via an energy source (not shown). The microchip/internal module/processor 420 and/or the rechargeable battery 426 may be enclosed and/or contained in an encasement 430.

In one or more techniques, the encasement 430 may be constructed of rubber or like material(s), perhaps similar to or identical with the material used to construct the air bladder 424 and/or a material(s) suitable to provide reasonable stability and/or protection for the microchip/internal module/processor 420 and/or the rechargeable battery 426, perhaps for example while the sport ball 412 is put to its reasonably intended use, or otherwise. In one or more techniques, the encasement 430 may be constructed of one or more materials different than that of the air bladder 424 (e.g., a rubber, a metal, alloy, polymer, elastomer, etc.) and/or a material(s) suitable to provide reasonable stability and/or protection for the microchip/internal module/processor 420 and/or the rechargeable battery 426 while the sport ball 412 is being put to its reasonably intended use, or otherwise.

In one or more techniques, the encasement 430 may comprise more than one physical structure. For example, the encasement 430 may comprise at least two encasements (not shown), perhaps in which one encasement may contain the microchip/internal module/processor 420, while perhaps a second encasement may contain the rechargeable battery 426. Stated somewhat differently, one more techniques contemplate that the encasement 430 may include two or more encasements that may perform in substantially the same manner as perhaps one encasement 430.

In one or more techniques, the sport ball 412 may include at least one counterweight 440. The counterweight 440 may be constructed of rubber or like material(s), perhaps similar to or identical with the material used to construct the air bladder 424 and/or a material suitable to provide a reasonably effective counterweight to the microchip/internal module/processor 420, the rechargeable battery 426, and/or or the encasement 430, perhaps for example while the sport ball 412 is put to its reasonably intended use, or otherwise. In one or more techniques, the counterweight 440 may be constructed of one or more materials different than that of the air bladder 424 (e.g., rubber, a metal, alloy, polymer, elastomer, etc.) and/or suitable to provide a reasonably effective counterweight to the microchip/internal module/pressure 420, the rechargeable battery 426, and/or or the encasement 430, perhaps for example while the sport ball 412 is put to its reasonably intended use, or otherwise.

In one or more techniques, the counterweight 440 may comprise more than one physical structure. For example, the counterweight 440 may comprise at least two counterweights (not shown). Stated somewhat differently, one more techniques contemplate that the counterweight 440 may include two or more counterweights that may perform in substantially the same manner as perhaps one counterweight 440.

In one or more techniques, the mass and/or weight of the counterweight 440 may be determined based on one or more selected materials of construction and/or the mass and/or weight that may provide a reasonably effective counterweight to the microchip/internal module/processor 420, the rechargeable battery 426, and/or or the encasement 430, perhaps for example while the sport ball 412 is put to its reasonably intended use, or otherwise.

Figure 5:
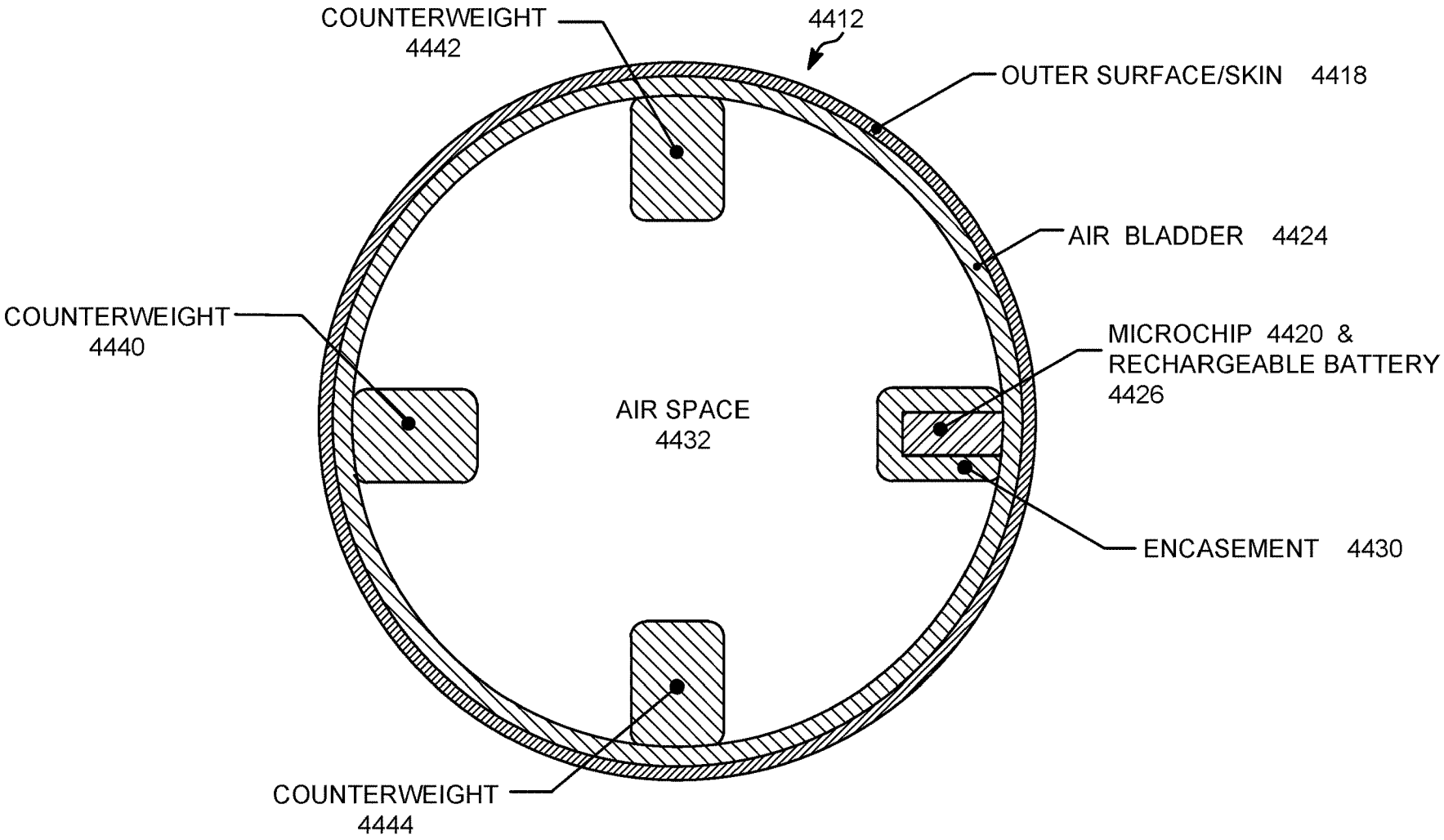
FIG. 5 illustrates an example partial cross-sectional schematic view of a sport ball.

FIG. 5 illustrates an example illustration of a partial cross-section of a sport ball. The sport ball 4412 of FIG. 5 may be a basketball. In one or more techniques, any ball, disk, puck, and/or other object may be used as the sport ball 4412. The sport ball 4412 may include a sensor layer (not shown) disposed under and/or adjacent to an outer surface/skin/layer 4418 of the sport ball 4412. The sport ball 4412 may include an air bladder 4424, perhaps for example constructed of rubber or a like material. The air bladder 4424 may encapsulate an air space 4432, or whatever other suitable gas that may be used to inflate the air bladder 4424. The sport ball 4412 may include a microchip/internal module/processor 4420. The sport ball 4412 may include a rechargeable battery 4426. The sport ball 4412 may include an inductive charging coil (not shown) that may be used to charge/recharge the rechargeable battery 4426 via an energy source (not shown). The microchip/internal module/processor 4420 and/or the rechargeable battery 4426 may be enclosed and/or contained in an encasement 4430.

In one or more techniques, the encasement 4430 may be constructed of rubber or like material(s), perhaps similar to or identical with the material used to construct the air bladder 4424 and/or a material(s) suitable to provide reasonable stability and/or protection for the microchip/internal module/processor 4420 and/or the rechargeable battery 4426, perhaps for example while the sport ball 4412 is put to its reasonably intended use, or otherwise. In one or more techniques, the encasement 4430 may be constructed of one or more materials different than that of the air bladder 4424 (e.g., a rubber, a metal, alloy, polymer, elastomer, etc.) and/or a material(s) suitable to provide reasonable stability and/or protection for the microchip/internal module/processor 4420 and/or the rechargeable battery 4426 while the sport ball 4412 is being put to its reasonably intended use, or otherwise.

In one or more techniques, the encasement 4430 may comprise more than one physical structure. For example, the encasement 4430 may comprise at least two encasements (not shown), perhaps in which one encasement may contain the microchip/internal module/processor 4420, while perhaps a second encasement may contain the rechargeable battery 4426. Stated somewhat differently, one more techniques contemplate that the encasement 4430 may include two or more encasements that may perform in substantially the same manner as perhaps one encasement 4430.

In one or more techniques, the sport ball may include at least three counterweights, counterweight 4440, counterweight 4442, and/or counterweight 4444. One or more of the counterweights 4440, 4442, and/or 4444 may be constructed of rubber or like material(s), perhaps similar to or identical with the material used to construct the air bladder 4424 and/or a material suitable to provide a reasonably effective counterweight to the microchip/internal module/processor 4420, the rechargeable battery 4426, and/or or the encasement 4430, perhaps for example while the sport ball 4412 is put to its reasonably intended use, or otherwise. In one or more techniques, one or more of the counterweights 4440, 4442, and/or 4444 may be constructed of one or more materials different than that of the air bladder 4424 (e.g., rubber, a metal, alloy, polymer, elastomer, etc.) and/or suitable to provide a reasonably effective counterweight to the microchip/internal module/processor 4420, the rechargeable battery 4426, and/or or the encasement 4430, perhaps for example while the sport ball 4412 is put to its reasonably intended use, or otherwise.

In one or more techniques, the counterweights 4440, 4442, and/or 4444 may comprise more than one physical structure. For example, the counterweights 4440, 4442, and/or 4444 may comprise at least two counterweights (not shown). Stated somewhat differently, one more techniques contemplate that the counterweights 4440, 4442, and/or 4444 may include two or more counterweights that may perform in substantially the same manner as perhaps one counterweight 4440, one counterweight 4442, and/or one counterweight 4444.

In one or more techniques, the mass and/or weight of one or more of the counterweights 4440, 4442, and/or 4444 may be determined based on one or more selected materials of construction and/or the mass and/or weight that may provide a reasonably effective counterweight to the microchip/internal module/processor 4420, the rechargeable battery 4426, and/or or the encasement 4430, perhaps for example while the sport ball 4412 is put to its reasonably intended use, or otherwise.

Figure 6:
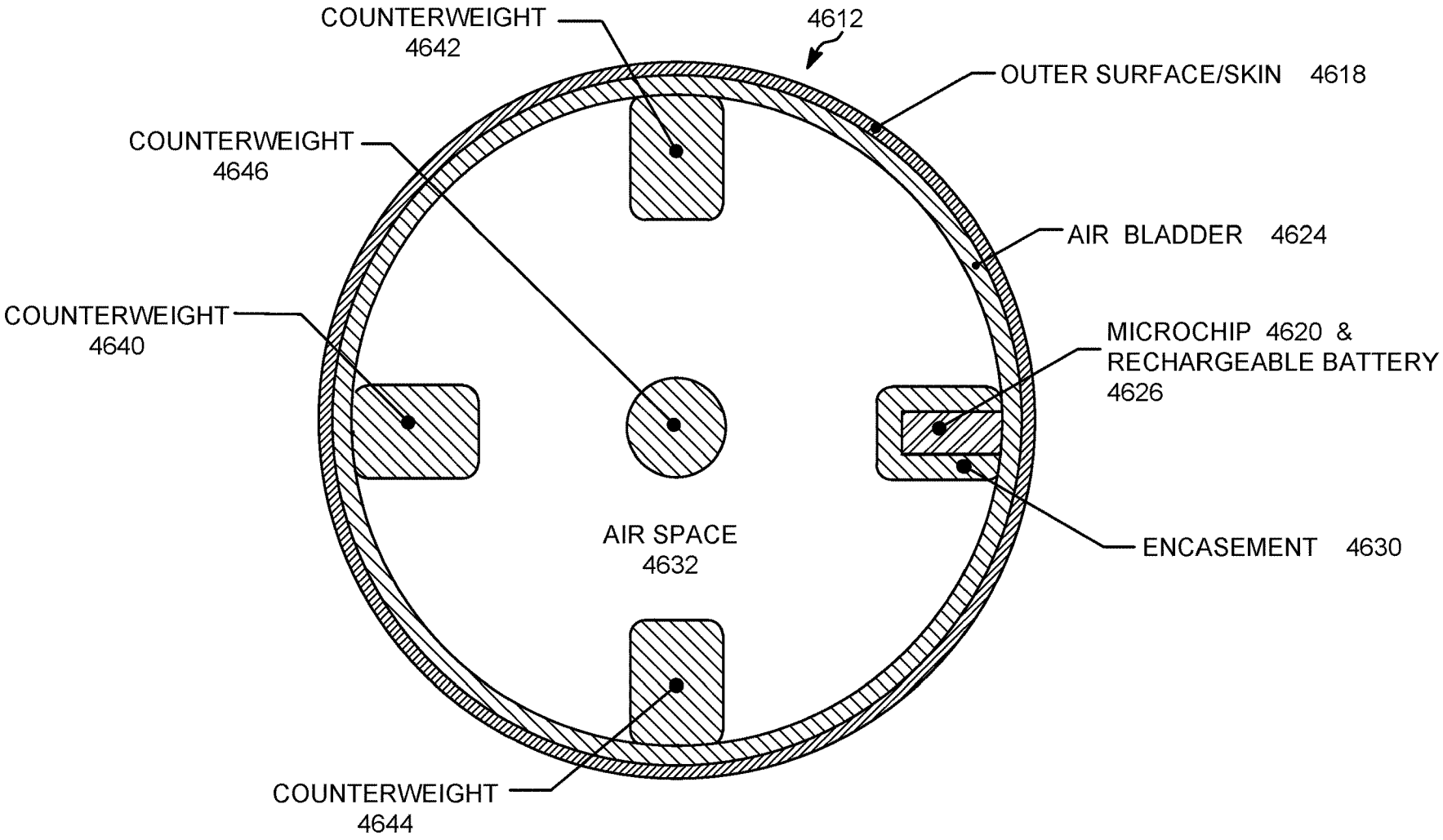
FIG. 6 illustrates an example partial cross-sectional schematic view of a sport ball.

FIG. 6 illustrates an example illustration of a partial cross-section of a sport ball. The sport ball 4612 of FIG. 6 may be a basketball. In one or more techniques, any ball, disk, puck, and/or other object may be used as the sport ball 4612. The sport ball 4612 may include a sensor layer (not shown) disposed under and/or adjacent to an outer surface/skin/layer 4618 of the sport ball 4612. The sport ball 4612 may include an air bladder 4624, perhaps for example constructed of rubber or a like material. The air bladder 4624 may encapsulate an air space 4632, or whatever other suitable gas that may be used to inflate the air bladder 4624. The sport ball 4612 may include a microchip/internal module/processor 4620. The sport ball 4612 may include a rechargeable battery 4626. The sport ball 4612 may include an inductive charging coil (not shown) that may be used to charge/recharge the rechargeable battery 4626 via an energy source (not shown). The microchip/internal module/processor 4620 and/or the rechargeable battery 4626 may be enclosed and/or contained in an encasement 4630.

In one or more techniques, the encasement 4630 may be constructed of rubber or like material(s), perhaps similar to or identical with the material used to construct the air bladder 4624 and/or a material(s) suitable to provide reasonable stability and/or protection for the microchip/internal module/processor 4620 and/or the rechargeable battery 4626, perhaps for example while the sport ball 4612 is put to its reasonably intended use, or otherwise. In one or more techniques, the encasement 4630 may be constructed of one or more materials different than that of the air bladder 4624 (e.g., a rubber, a metal, alloy, polymer, elastomer, etc.) and/or a material(s) suitable to provide reasonable stability and/or protection for the microchip/internal module/processor 4620 and/or the rechargeable battery 4626 while the sport ball 4612 is being put to its reasonably intended use, or otherwise.

In one or more techniques, the encasement 4630 may comprise more than one physical structure. For example, the encasement 4630 may comprise at least two encasements (not shown), perhaps in which one encasement may contain the microchip/internal module/processor 4620, while perhaps a second encasement may contain the rechargeable battery 4626. Stated somewhat differently, one more techniques contemplate that the encasement 4630 may include two or more encasements that may perform in substantially the same manner as perhaps one encasement 4630.

In one or more techniques, the sport ball 4612 may include at least five counterweights, counterweight 4640, counterweight 4642, counterweight 4644, counterweight 4646, and/or a fifth counterweight (not shown). In one or more techniques, the fifth counterweight may be disposed substantially diametrically from counterweight 4646. One or more of the counterweights 4640, 4642, 4644, 4646, and/or the fifth counterweight may be constructed of rubber or like material(s), perhaps similar to or identical with the material used to construct the air bladder 4624 and/or a material suitable to provide a reasonably effective counterweight to the microchip/internal module/processor 4620, the rechargeable battery 4626, and/or or the encasement 4630, perhaps for example while the sport ball 4612 is put to its reasonably intended use, or otherwise. In one or more techniques, one or more of the counterweights 4640, 4642, 4644, 4646, and/or the fifth counterweight may be constructed of one or more materials different than that of the air bladder 4624 (e.g., a rubber, a metal, alloy, polymer, elastomer, etc.) and/or suitable to provide a reasonably effective counterweight to the microchip/internal module/processor 4620, the rechargeable battery 4626, and/or or the encasement 4630, perhaps for example while the sport ball 4612 is put to its reasonably intended use, or otherwise.

In one or more techniques, the counterweights 4640, 4642, 4644, 4646, and/or the fifth counterweight may comprise more than one physical structure. For example, the counterweights 4640, 4642, 4644, 4646, and/or the fifth counterweight may comprise at least two counterweights (not shown). Stated somewhat differently, one more techniques contemplate that the counterweights 4640, 4642, 4644, 4646, and/or the fifth counterweight may include two or more counterweights that may perform in substantially the same manner as perhaps one counterweight 4640, one counterweight 4642, one counterweight 4644, one counterweight 4646, and/or one fifth counterweight.

In one or more techniques, the mass and/or weight of one or more of the counterweights 4640, 4642, 4644, 4646, and/or the fifth counterweight may be determined based on one or more selected materials of construction and/or the mass and/or weight that may provide a reasonably effective counterweight to the microchip/internal module/processor 4620, the rechargeable battery 4626, and/or or the encasement 4630, perhaps for example while the sport ball 4612 is put to its reasonably intended use, or otherwise.

Figure 7:
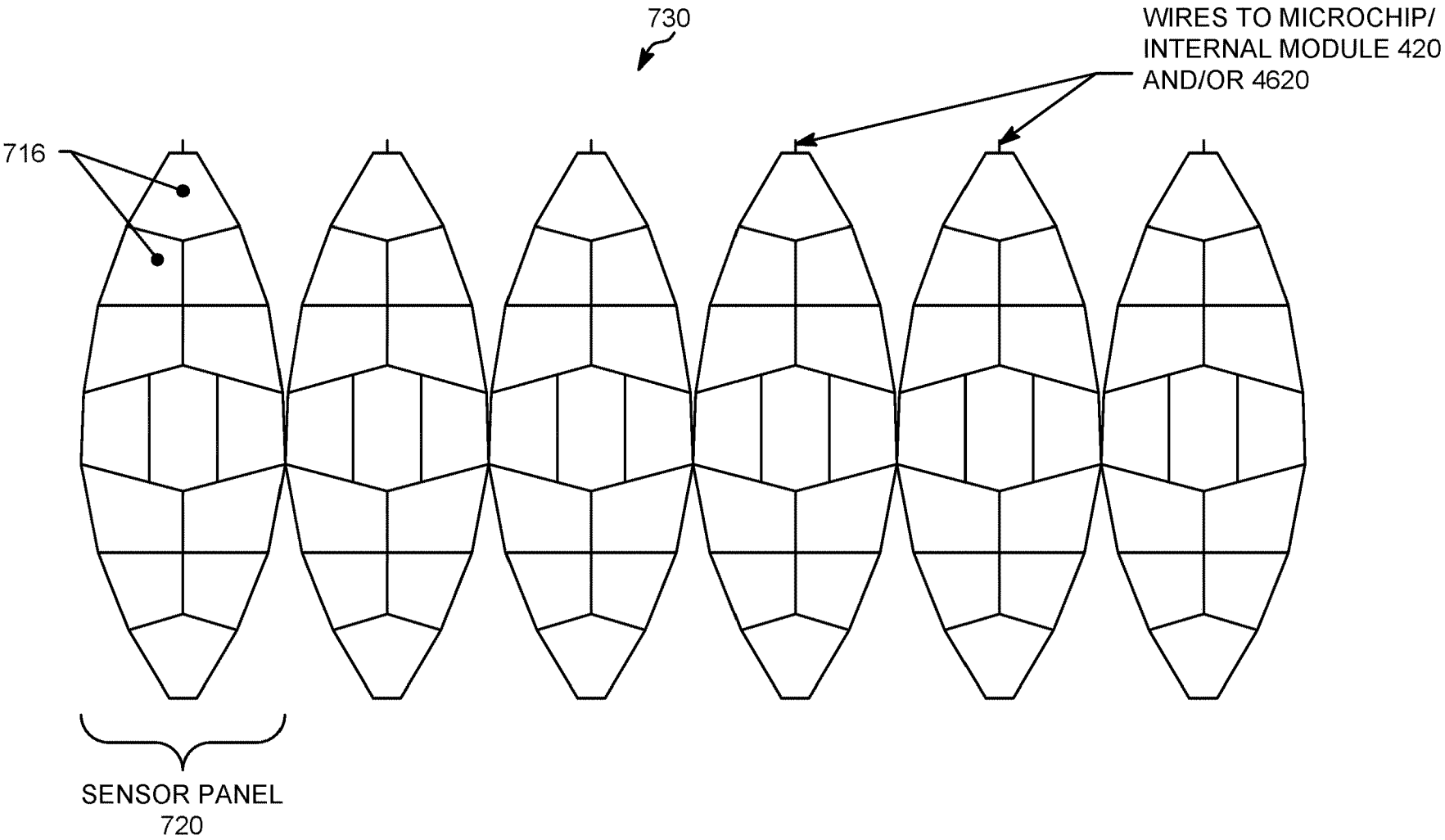
FIG. 7 illustrates an example sphere gore pattern of a pressure sensor array on a surface of a sport ball.

FIG. 7 illustrates an example pattern of a plurality of pressure sensors 716 (e.g., a sensor array and/or roll-to-roll printed sensors). The sensor array 730 is illustrated in FIG. 7 by a sphere gore method to show distribution of one or more of the plurality of pressure sensors 716. For example, one or more of the plurality of pressure sensors 716 may be resistive (e.g., fixed and/or variable size) force sensors (e.g., with fixed and/or variable density), among other type of sensors that may be used to measure and/or derive pressure. One or more of the plurality of pressure sensors 716 may be disposed in accordance with any other pattern.

In FIG. 7, one or more pressure sensors 716 may be arranged to form a (e.g., one/single) sensor panel 720. The sensor array 730 may comprise one or more sensor panels 720, for example six sensor panels 720 as illustrated in FIG. 7, among other scenarios. For example, one or more panels 720 may be combined to form the sensor array 730 which may be disposed over/on and/or adjacent to the air bladder 424, air bladder 4424, and/or air bladder 4624 to create a (e.g., complete) sensor skin (not shown).

Two or more, or each, pressure sensor 716 may be paired to another, perhaps diametrically opposed pressure sensor 716, to form one or more sensor pairs (not shown). Such sensor pairs may contribute to sport ball 12, sport ball 412, sport ball 4412, and/or sport ball 4612, handling evaluation(s) as described herein.

One or more, or each, of the plurality of pressure sensors 16 and/or 716 may be configured to cooperate with the microchip/internal module/processor 20 and/or 420 to generate one or more, or a plurality, of force values between the plurality of pressure sensors 16 and/or 716 and a user upon engagement/use of the sport ball 12, sport ball 412, sport ball 4412, and/or sport ball 4612 by/with the user.

Figure 8:
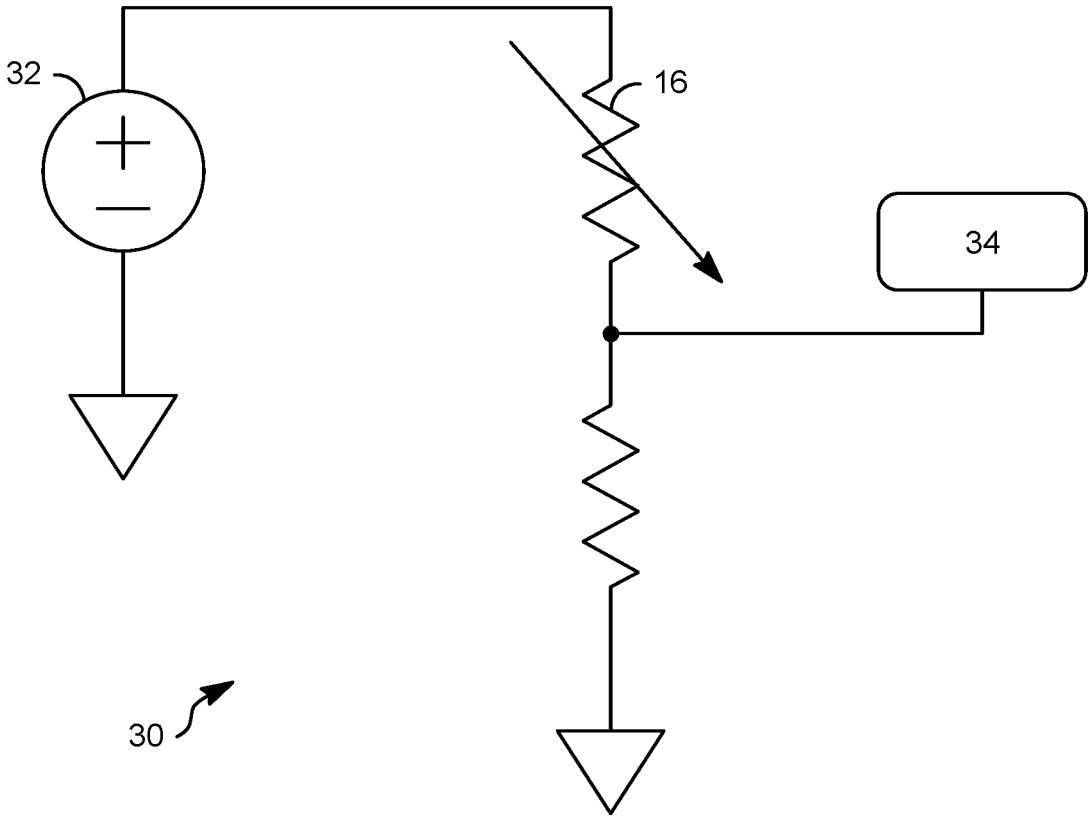
FIG. 8 illustrates a schematic view of a pressure sensor circuit that may be disposed on a sport ball.

In FIG. 8, a circuit 30 for one or more, or each, pressure sensor 16 and/or 716 may include a power source 32, at least one pressure sensor 16, and/or an output 34. The output 34 may detect a variation in a voltage across the circuit 30 and/or may transmit the signal to the microchip/internal module/processor 20 and/or 420, perhaps for example to record one or more force values. In one or more techniques, the pressure sensor 16 may be a model FSR 406 sensor available from Interlink Electronics of Westlake Village, Calif., for example, among other sensors. In one or more techniques, any contact, pressure, force, and/or other type of sensor or device capable of sensing contact, pressure, and/or a type of force may be utilized as one, some, or all of the plurality of pressure sensors 16 and/or 716.

The microchip/internal module/processor 20 and/or 420 may include a transmitter (not shown) that may transmit one or more, or a plurality, of force values and/or any other data to the computing device 104. The computing device 104 may be an external module/processing device that may be used in concert with any of the sport balls disclosed herein. The transmission of the one or more force values and/or other data may be accomplished by wireless transmission, for example, at least by any wireless transmission capabilities described herein. The one or more force values and/or other data may be stored internally within any of the sport balls described herein (e.g., in a physical memory of the microchip/internal device 20 and/or 420). In one or more techniques, the one or more force values and/or other data may be transmitted after use/engagement of any of the sport balls described herein and/or during use/engagement of any of the sport balls described herein, such as by wired and/or wireless connection, physical memory removal and/or transfer, and/or any other techniques of transmitting data.

Figure 9:
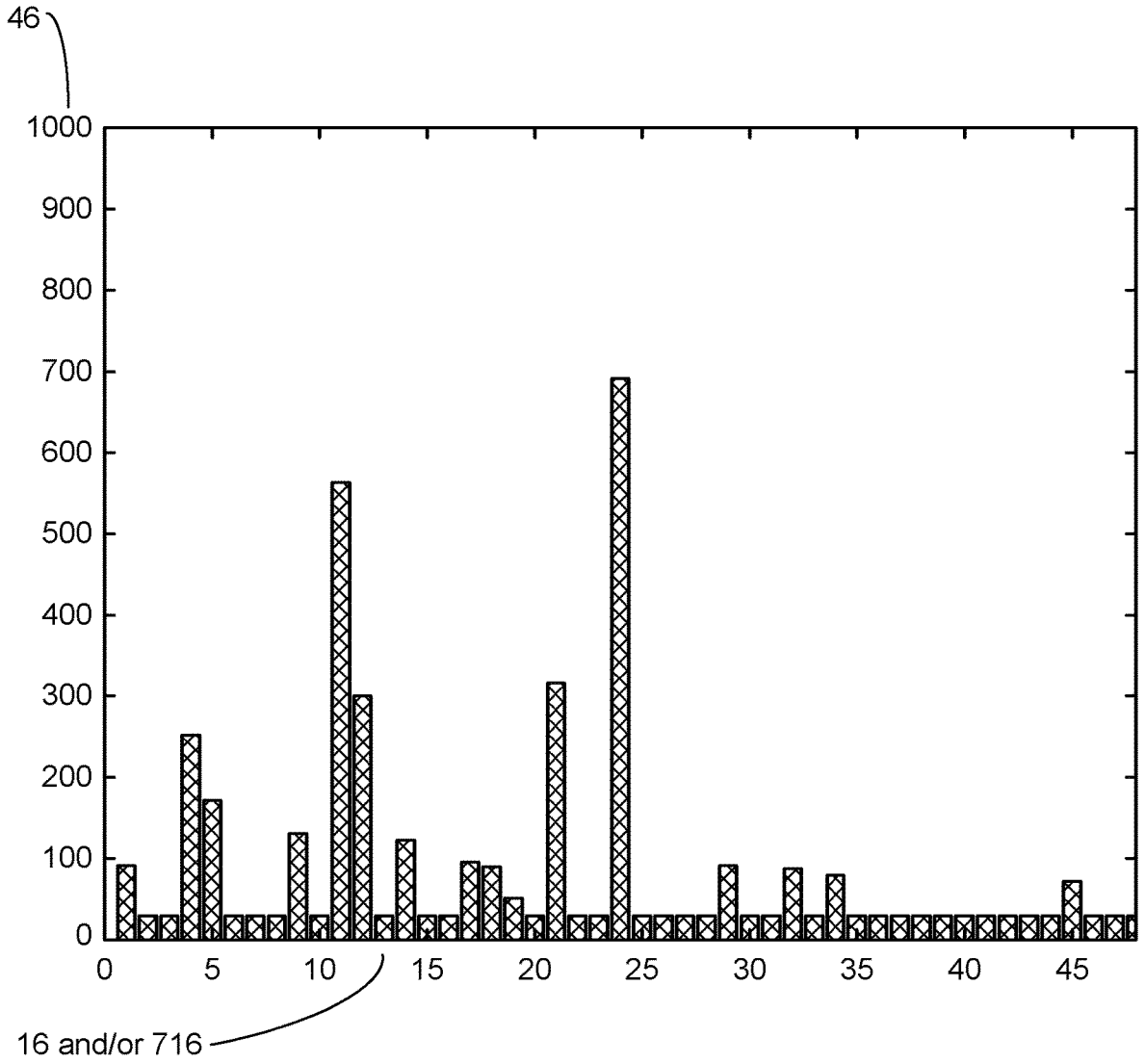
FIG. 9 is a graphical display of an example handling value(s) determined from use/engagement of a sport ball.

FIG. 9 illustrates an example chart of one or more analysis values derived from use/engagement of any of the sport balls described herein. The computing device 104 may be configured to determine one or more handling value(s) 42, perhaps for example based on one or more of the plurality of force values 46 for qualitative determination of an interaction/use/engagement with the sport ball 12, sport ball 412, sport ball 4412, and/or sport ball 4612, such as catching, rebounding, hitting, blocking, throwing, and/or handling to name just some non-limiting examples. In one or more techniques, the microchip/internal module/processor 20 and/or 420 may determine the one or more handling values 42. In one or more techniques, the microchip/internal module/processor 20 and/or 420 may process one or more, or all, of the functions of the computing device 104. In one or more techniques, the computing device 104 may or might not be used.

In FIG. 9, the one or more handling value(s) 42 may be displayed with additional data, such as for example, one or more of the plurality of force values 46 for one or more, or each pressure sensor 16 and/or 716. The computing device 104 may be configured to determine one or more of the handling value(s) 42, perhaps for example based upon one or more of: a mean force value F, a time value T, and/or an active sensor value S. For example, at least one handling value(s) 42 may be determined in accordance with the following equation:

$$\text{Handling Value } 42 = A*F+B*T+C*S$$

wherein A, B, and/or C are weighing factors that may be varied in order, perhaps for example to adjust the one or more handling value(s) 42 based on one or more particular applications.

The time value T may be based upon a time threshold $T_{thresh}$ from a beginning of a user engagement of the sport ball 12, sport ball 412, sport ball 4412, and/or sport ball 4612 to a completion of the user use/engagement of the sport ball 12, sport ball 412, sport ball 4412, and/or sport ball 4612. In one or more techniques, the time threshold $T_{thresh}$ may be a predetermined, preprogrammed, and/or hardcoded value. In one or more techniques, the time value T may be based on a mean time $T_{mean}$ that may be determined from a beginning of a user engagement/use with an active sensor to a completion of the user engagement/use with the active sensor. In one or more techniques, an active sensor may be a pressure sensor 16 and/or 716 of one or more of the twenty-two sensor pairs, where the active sensor's diametrically opposed pressure sensor 16 and/or 716 may generate at least one force value. In one or more techniques, the time value T may be determined by the following equation:

$$\text{Time Value } T=(T_{thresh}-T_{mean})/T_{thresh}$$

The computing device 104 may be configured to determine the one or more handling value(s) 42, perhaps for example based upon an active sensor value S based upon a number $N_P$ of paired sensors and/or diametrically opposed sensors generating force values. In one or more techniques, the active sensor value S may be based upon a total number $N_T$ of pressure sensors 16 and/or 716 generating force values. The active sensor value S may provide information relating to the position of contact and/or handling by the user on the sport ball 12, sport ball 412, sport ball 4412, and/or sport ball 4612. In one or more techniques, the active sensor value S may be determined by the following equation:

$$\text{Active Sensor Value } S=N_P/N_T$$

Any of the techniques using one or more of the sport ball 12, sport ball 412, sport ball 4412, and/or sport ball 4612 may provide a qualitative score and/or other calculation of a user's or player's grip, catch, and/or other handling behavior and/or technique, perhaps for example based on determination of force, time, and/or position of contact by the player or user. The weighing of one or more, or each, force, time, and/or position component to determine the handling value 42 may be modified, perhaps for example to emphasize the contribution of one or more, or each, component and/or customize the scoring and/or calculation.

In one or more techniques, calibration may be performed. Perhaps for example when an analysis program may (e.g., first) connect to one or more of the sport ball 12, sport ball 412, sport ball 4412, and/or sport ball 4612, the analysis program may survey one or more of the pressure sensors 16 and/or 716 for a baseline value and/or may tare the pressure sensors 16 and/or 716 readings, perhaps before analysis.

In one or more techniques, noise cancelation may be performed. Low intensity values and/or high frequency data might not be (may be unlikely to be) from a human user. Such values and/or data may be removed from the dataset, perhaps to improve the accuracy of the analysis.

Figure 10:
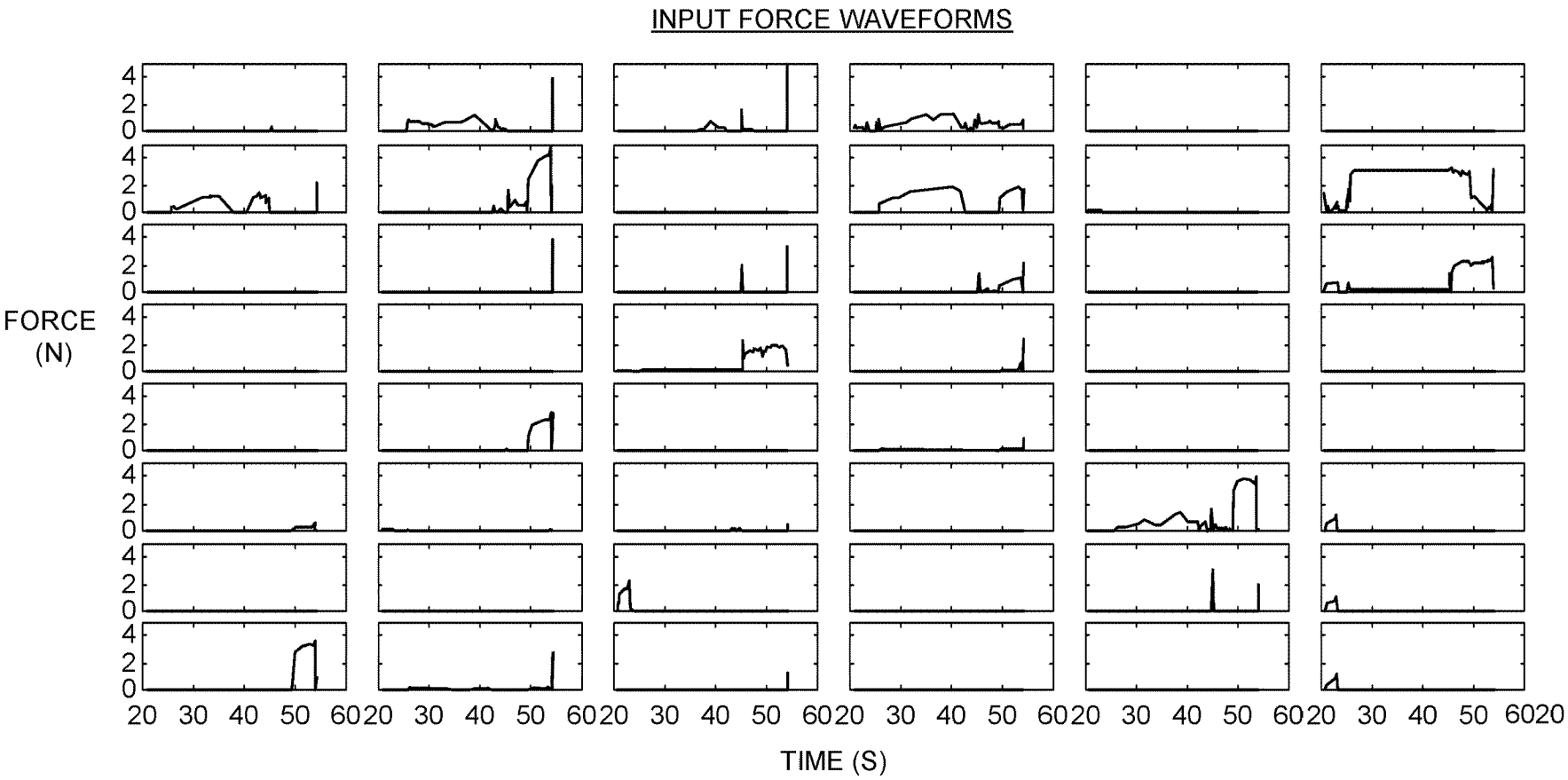
FIG. 10 is a graphical display of example waveforms from pressure sensors that may be disposed on a sport ball.
Figure 11:
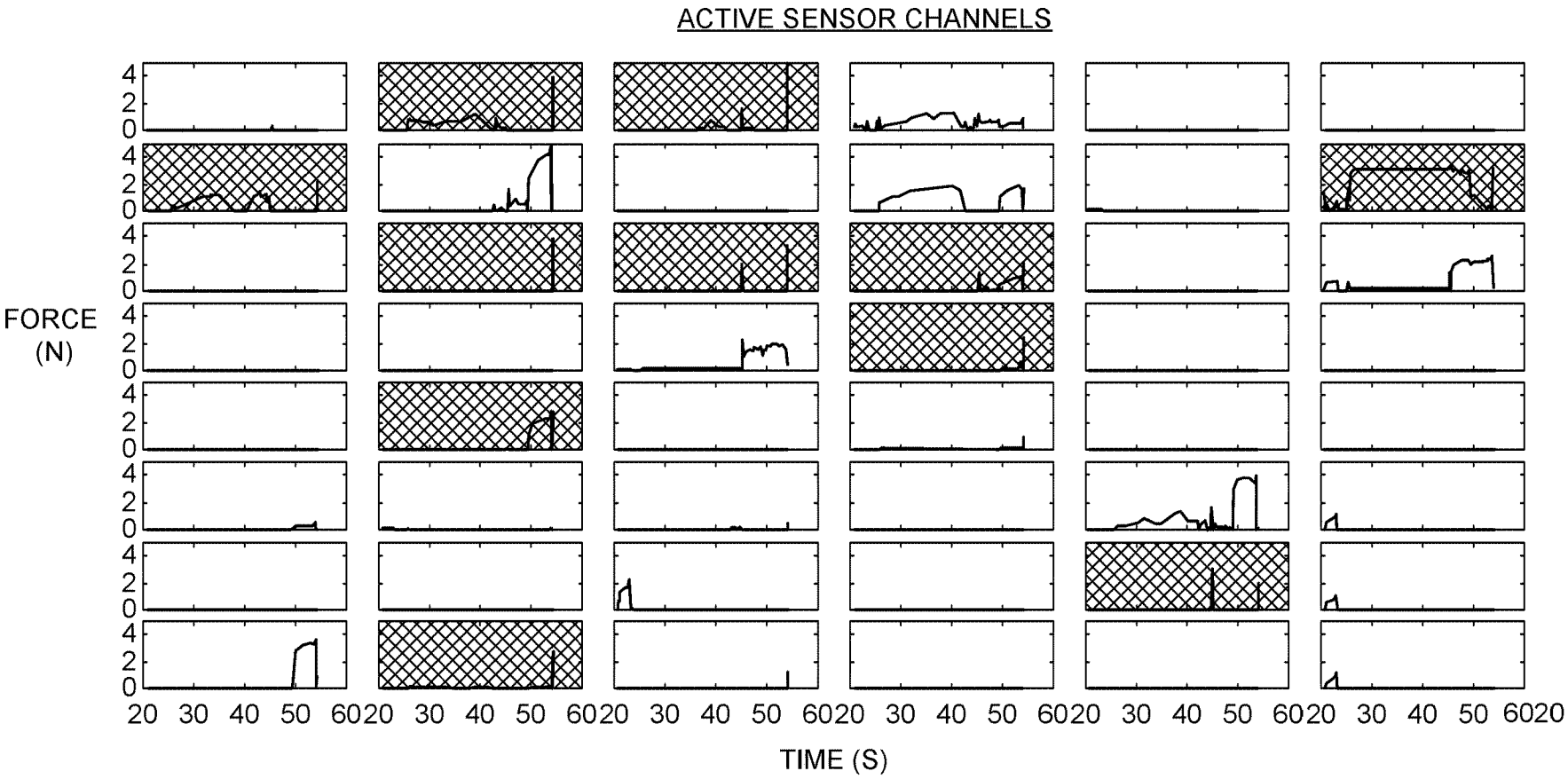
FIG. 11 is a graphical display of example pressure sensor activation determinations for pressure sensors that may be disposed on a sport ball.

In one or more techniques, active sensor detection may be performed. Perhaps once calibrated and/or cleaned of noise, if a pressure sensor 16 and/or 716 has a force over a threshold value, then the pressure sensor 16 and/or 716 may be considered an active sensor. FIG. 10 illustrates examples of one or more force inputs from one or more pressure sensors 16 and/or 716. FIG. 11 illustrates an example of a determination of which of the pressure sensors 16 and/or 716 may be active sensors, perhaps for example based on a comparison of the input force to one or more thresholds. In FIG. 11, the highlighted sensor channels may be considered active.

In one or more techniques, force quantification may be performed. Forces of one or more, or all, the active sensors may be recorded. Forces of one or more, or all, the active sensors may be analyzed individually as a measure of grip strength during one or more grip events, for example. In one or more techniques, mean value(s) across one or more, or all, pressure sensors may be used as a measure of the grip strength during one or more grip events, for example.

One or more techniques may perform position analysis. In one or more techniques, perhaps for example for one or more activated sensors to be considered part of a grip event, pressure sensors 16 and/or 716 on opposite sides of the basketball may be detected as activated at (e.g. substantially) the same time (e.g., detecting that hands are most likely grabbing the ball rather than the ball being dribbled, thrown, and/or partially grabbed). In one or more techniques, pressure sensors 16 and/or 716 disposed on opposite (e.g. diametric and/or relatively) sides of any of the sport balls described herein may be considered paired pressure sensors 16 and/or 716.

In one or more techniques, at least one sensor pairing can be one to one (e.g., a rigid pairing) for sensors disposed on any part (e.g., somewhat close, neighbor sensor, relatively opposite, and/or diametric opposite side) of any of the sport balls described herein. In one or more techniques, at least one sensor pairing can be one to more than one sensor (e.g., a region of sensors) disposed on any part (e.g., somewhat close, neighbor sensor, relatively opposite, and/or diametric opposite side) of any of the sport balls described herein (e.g., a broad pairing).

Figure 12A:
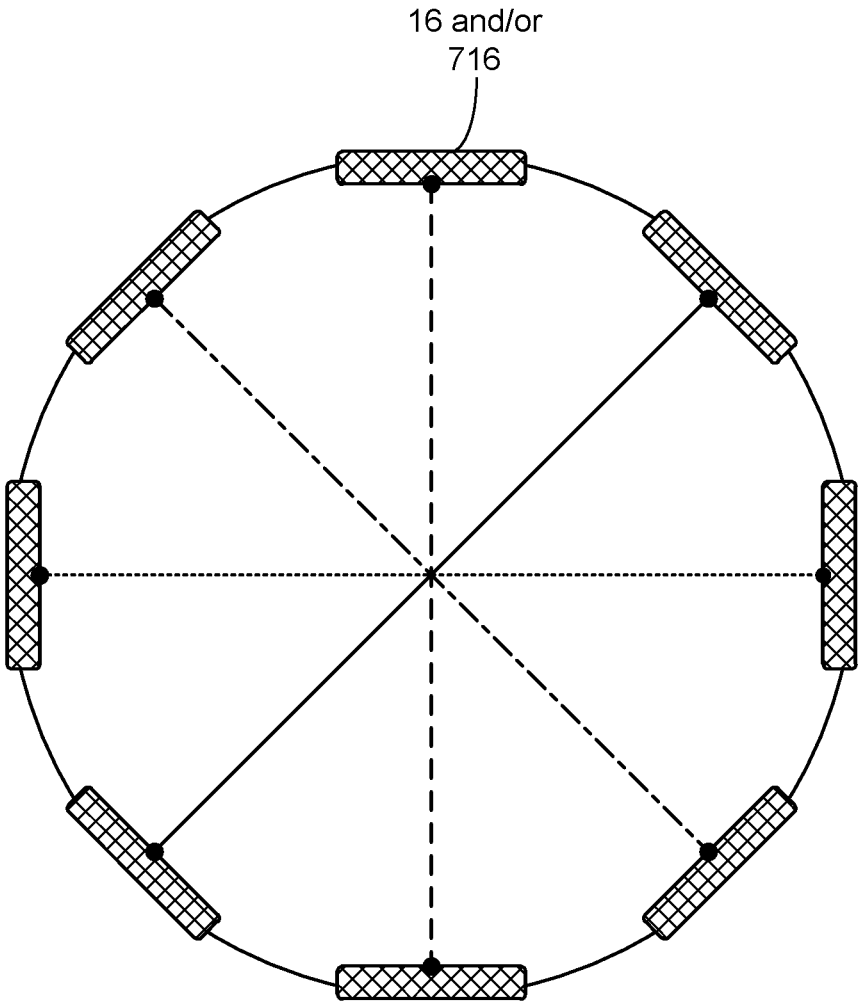
FIG. 12A illustrates an example partial cross-sectional schematic view of pairings of pressure sensors disposed on a sport ball.

FIG. 12A illustrates an example placement of eight pressure sensors 16 and/or 716 on an example sport ball (e.g., which could be any of the sport balls described herein). The eight sensors are used for illustration purposes, as more or less than eight sensors can be implemented. The differentiated lines between the respective pressure sensors 16 and/or 716 indicate the paired pressure sensors 16/and/or 716 (e.g., in the example of FIG. 12A, there are four pairs of pressure sensors 16 and/or 716). The sensor pairing illustrated in FIG. 12A may be a "rigid" pairing as the paired pressure sensors 16 and/or 716 are paired on a one-to-one basis.

Figure 12B:
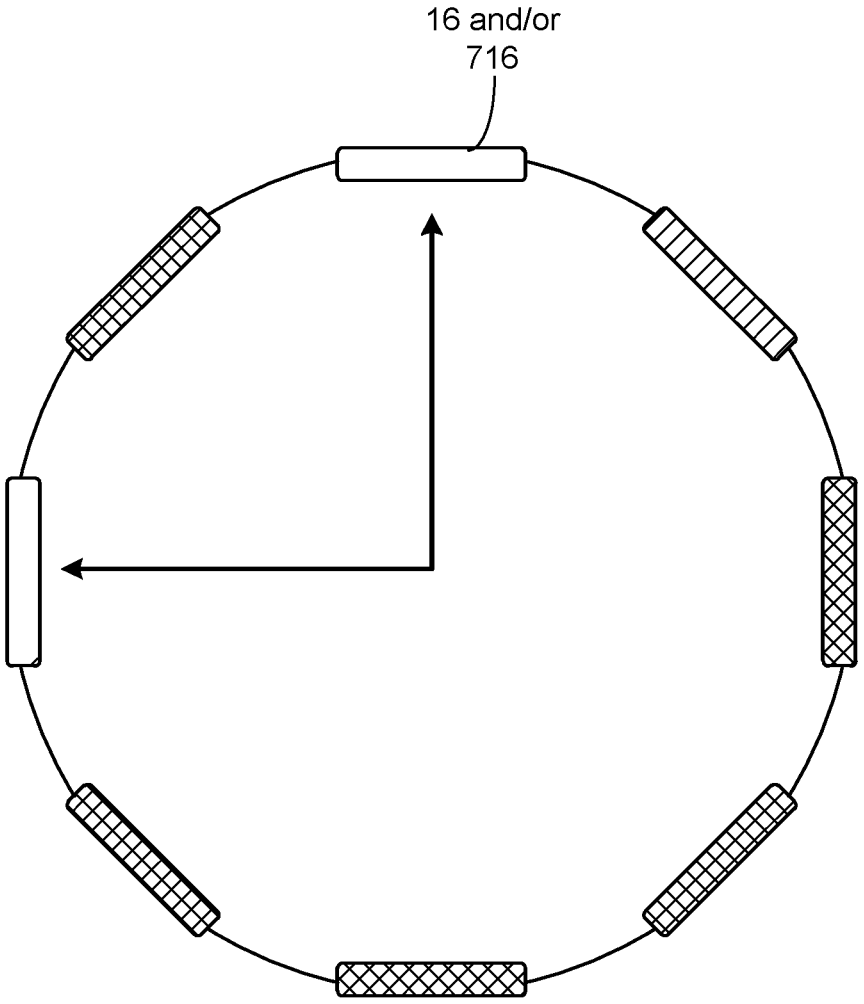
FIG. 12B illustrates an example partial cross-sectional schematic view of an activation of pressure sensors disposed on a sport ball.

FIG. 12B illustrates an example activation of two unpaired pressure sensors 16 and/or 716. In one or more techniques, the activation illustrated in FIG. 12B may be determined to not be a grip event.

Figure 12C:
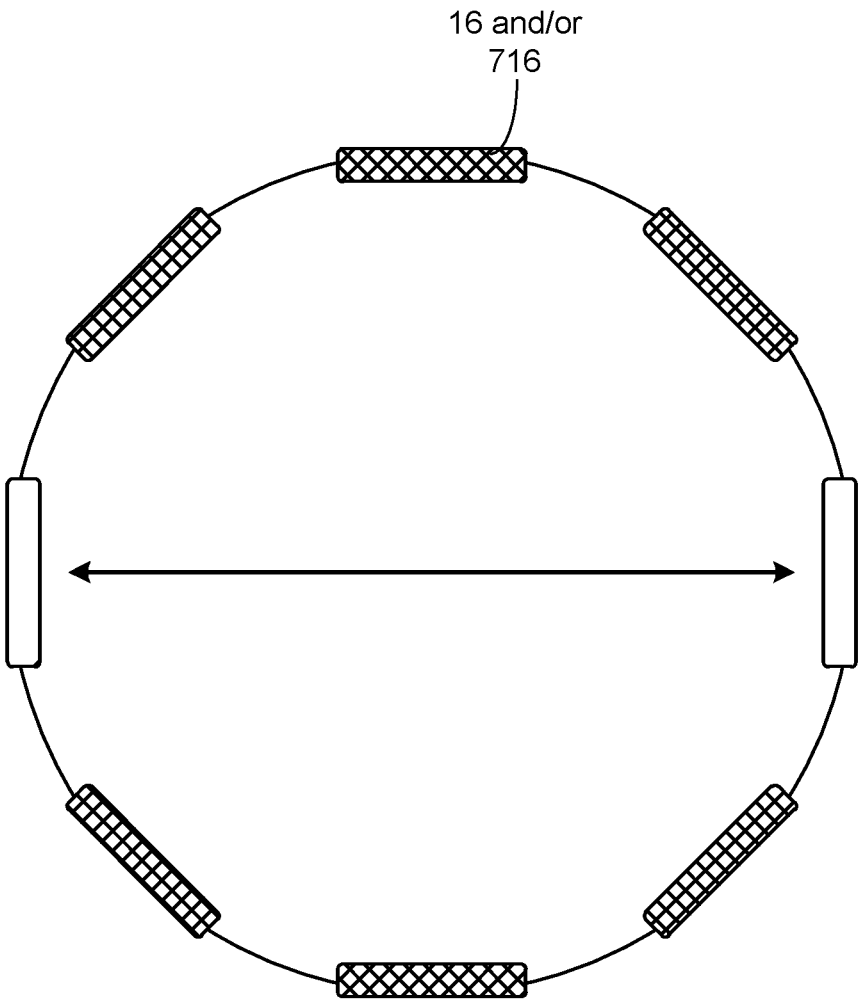
FIG. 12C illustrates an example partial cross-sectional schematic view of an activation of pressure sensors disposed on a sport ball.

FIG. 12C illustrates an example activation of two paired pressure sensors 16 and/or 716. In one or more techniques, the activation illustrated in FIG. 12C may be determined to be a grip event.

Figure 12D:
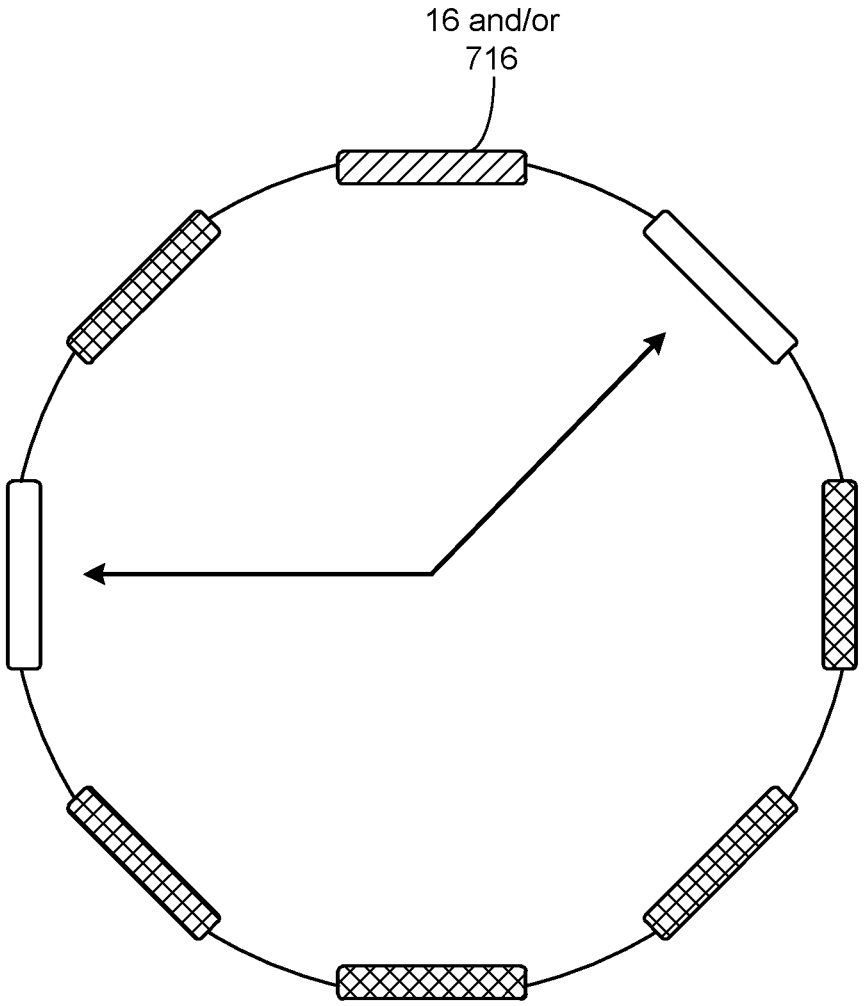
FIG. 12D illustrates an example partial cross-sectional schematic view of an activation of pressure sensors disposed on a sport ball.

FIG. 12D illustrates an example activation of two unpaired pressure sensors 16 and/or 716. In one or more techniques, the activation illustrated in FIG. 12D may be determined to not be a grip event.

Figure 13A:
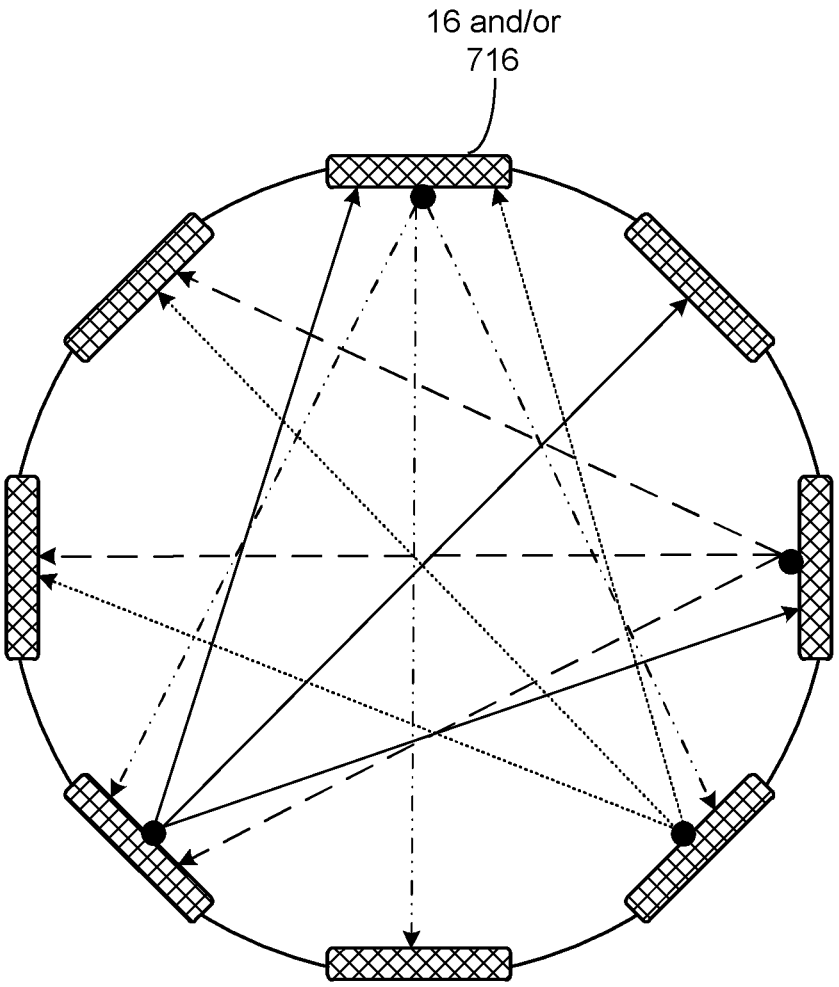
FIG. 13A illustrates an example partial cross-sectional schematic view of pairings of pressure sensors disposed on a sport ball.

FIG. 13A illustrates an example placement of eight pressure sensors 16 and/or 716 on an example sport ball (e.g., which could be any of the sport balls described herein). The eight sensors are used for illustration purposes, as more or less than eight sensors can be implemented. The differentiated lines between the respective pressure sensors 16 and/or 716 indicate the paired pressure sensors 16/and/or 716 (e.g., in the example of FIG. 13A, there are twelve pairs of pressure sensors 16 and/or 716, where more or less sensor pairings are possible). The sensor pairing illustrated in FIG. 13A may be a "broad" pairing as the paired pressure sensors 16 and/or 716 are paired on a one-to-more-than-one basis. In the example of FIG. 13A, pressure sensors 16 and/or 716 on opposite sides of the example sport ball as well as pressure sensors 16 and/or 716 that neighbor such opposite side pressure sensors 16 and/or 716 are paired. Other pairing patterns (not shown) are possible and are contemplated within the scope of this description.

Figure 13B:
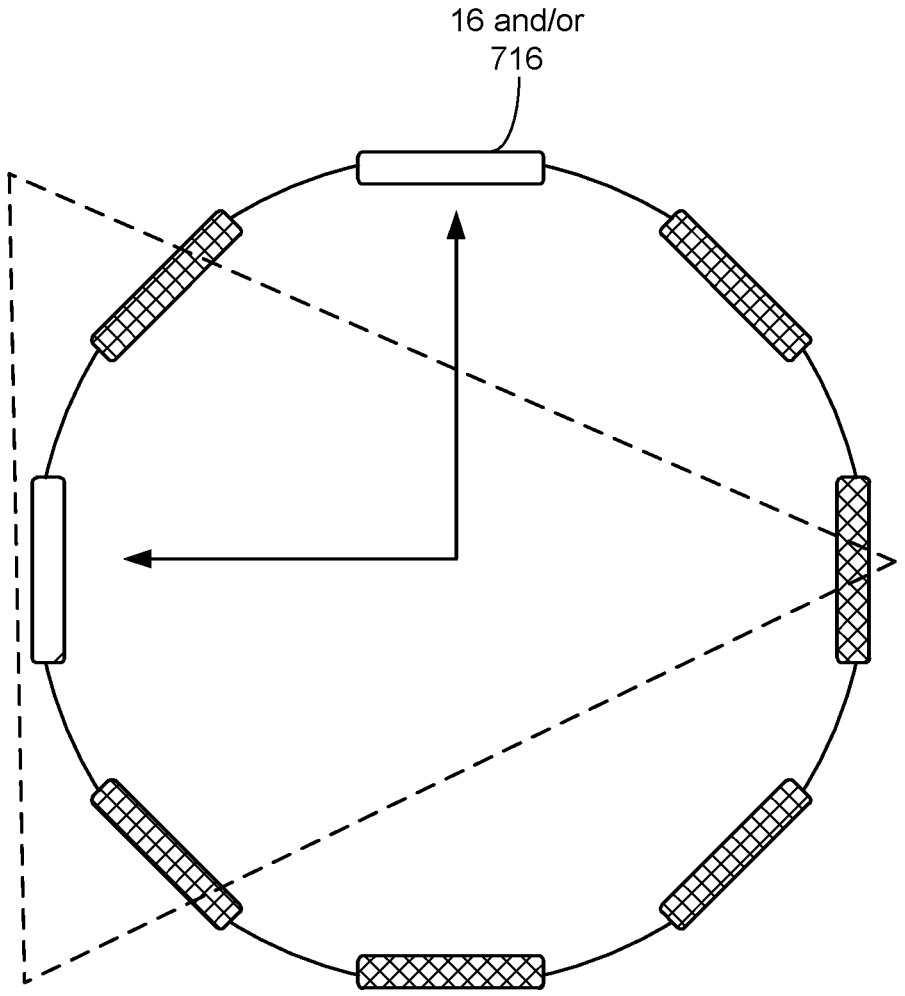
FIG. 13B illustrates an example partial cross-sectional schematic view of an activation of pressure sensors disposed on a sport ball.

FIG. 13B illustrates an example activation of two unpaired pressure sensors 16 and/or 716. Stated somewhat differently, the activation of the two pressure sensors 16 and/or 716 may be outside of a paired sensor region (e.g., as illustrated with a triangle shape in FIG. 13B). In one or more techniques, the activation illustrated in FIG. 13B may be determined to not be a grip event.

Figure 13C:
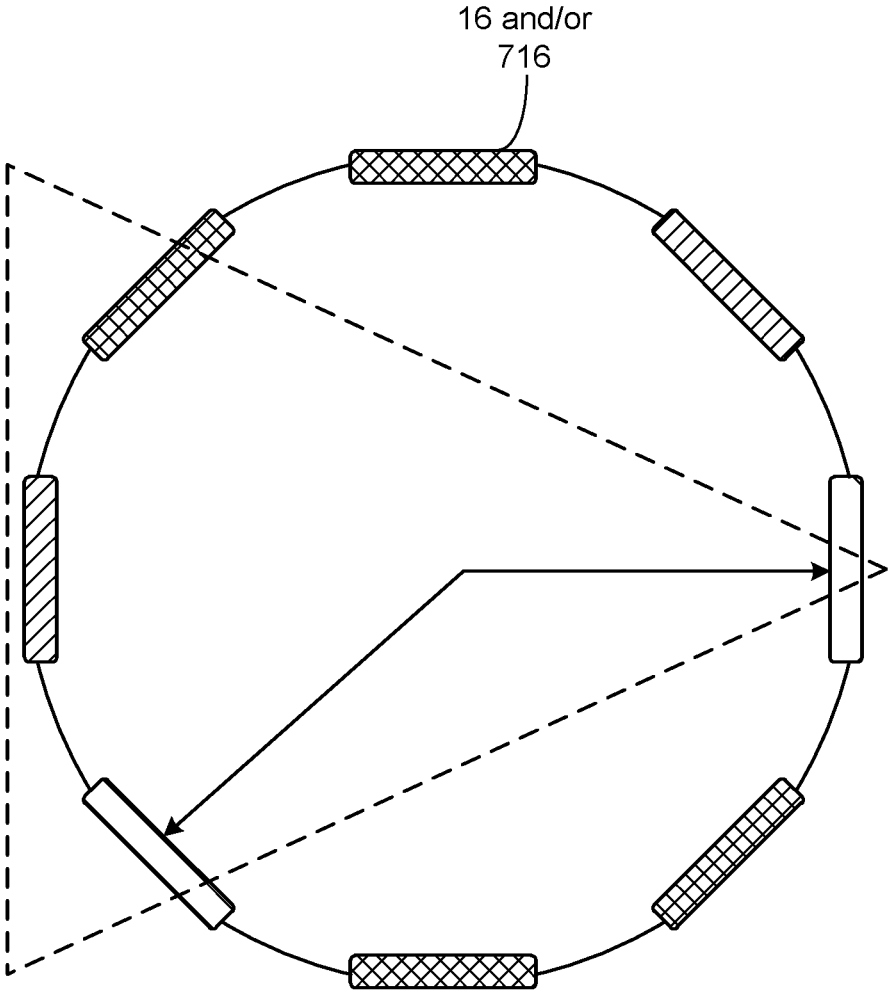
FIG. 13C illustrates an example partial cross-sectional schematic view of an activation of pressure sensors disposed on a sport ball.

FIG. 13C illustrates an example activation of two paired pressure sensors 16 and/or 716. Stated somewhat differently, the activation of the two pressure sensors 16 and/or 716 may be inside of a paired sensor region (e.g., as illustrated with a triangle shape in FIG. 13C). In one or more techniques, the activation illustrated in FIG. 13C may be determined to be a grip event.

Figure 13D:
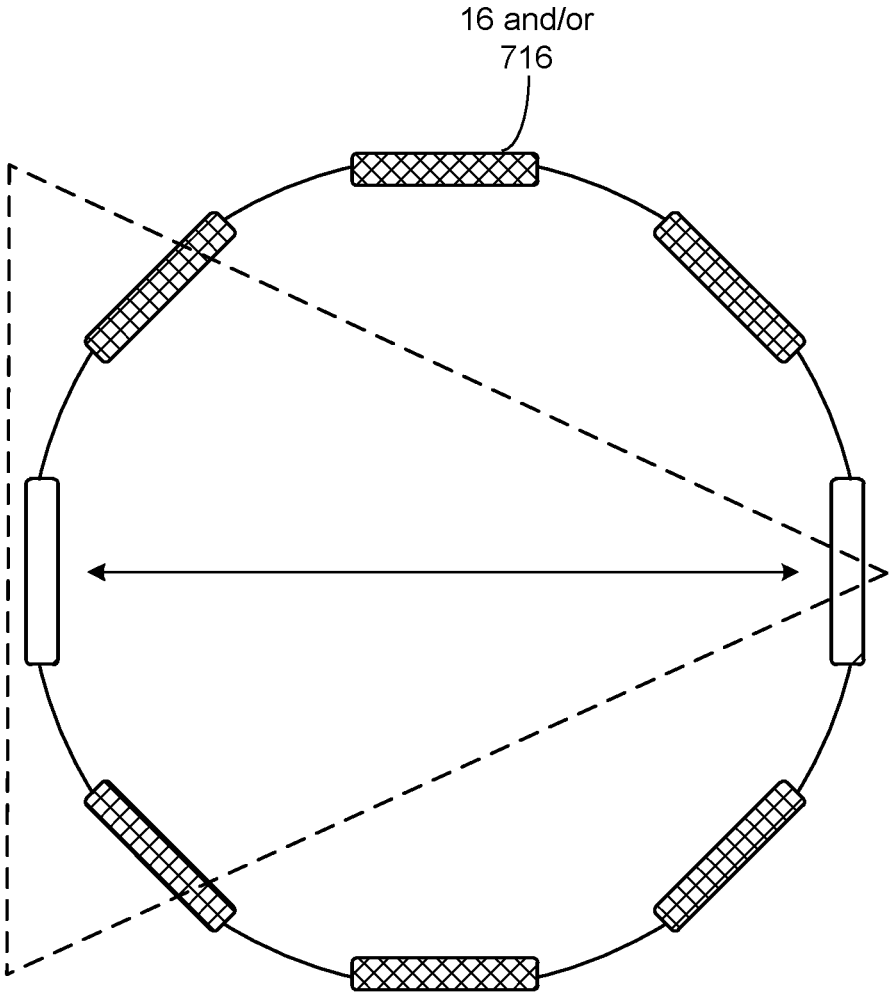
FIG. 13D illustrates an example partial cross-sectional schematic view of an activation of pressure sensors disposed on a sport ball.

FIG. 13D illustrates an example activation of two paired pressure sensors 16 and/or 716. Stated somewhat differently, the activation of the two pressure sensors 16 and/or 716 may be inside of a paired sensor region (e.g., as illustrated with a triangle shape in FIG. 13D). In one or more techniques, the activation illustrated in FIG. 13D may be determined to be a grip event.

One or more techniques may perform temporal analysis. In one or more techniques, perhaps for example to quantify the timing of a grip by a user of any of the sport balls described herein, among other scenarios, the time(s) that one or more, or each, pressure sensor 16 and/or 716 becomes activated may be recorded. The time(s) that one or more, or each, pressure sensor 16 and/or 716 becomes activated may be compared to the activation times of one or more paired pressure sensors 16 and/or 716.

Figure 14:
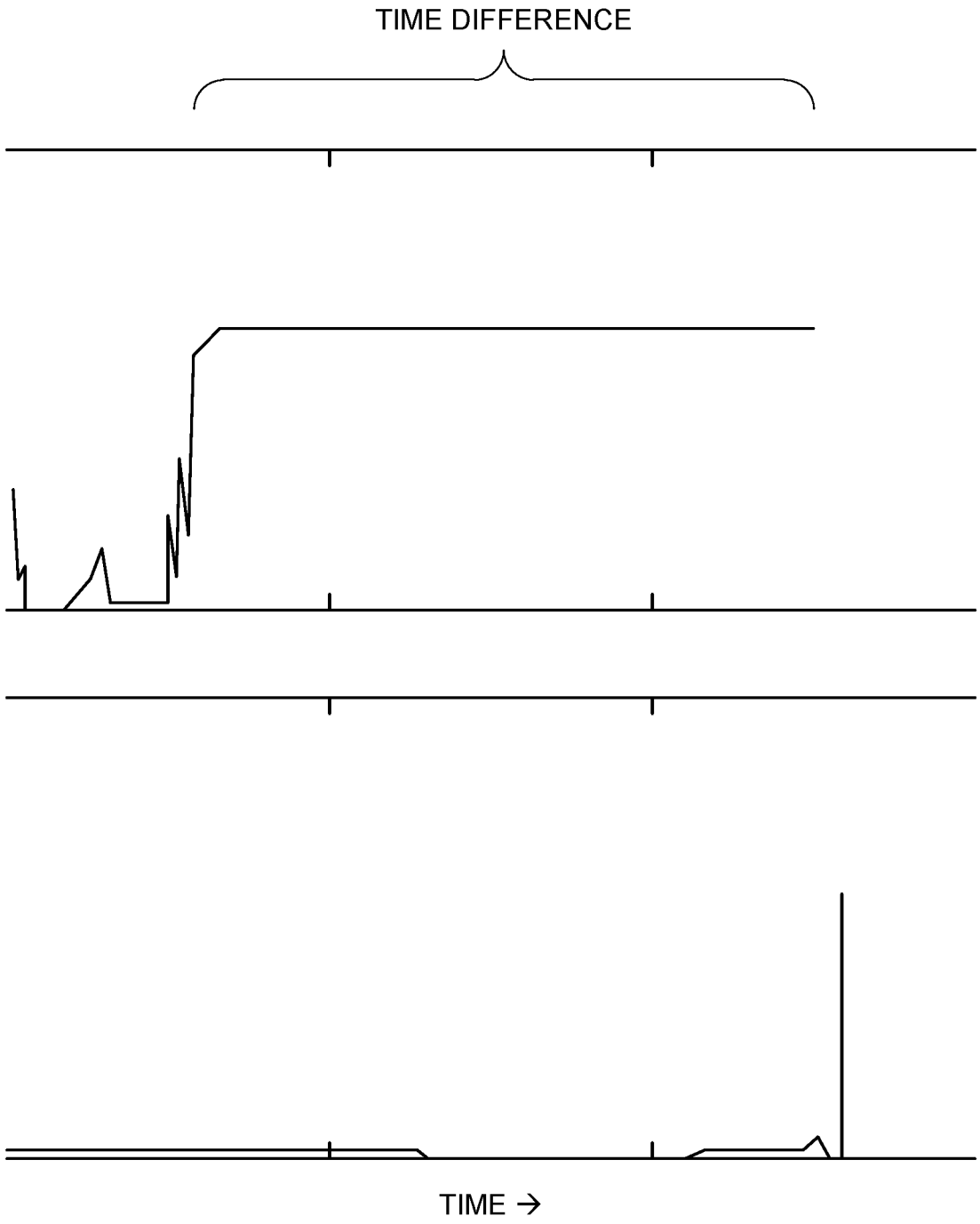
FIG. 14 is a graphical display of example pressure sensor activation timing measurements for pressure sensors that may be disposed on a sport ball.

In one or more techniques, the period of time between when a first and a second pressure sensor 16 and/or 716 of a pressure sensor pair activate may be referred to as a Time Difference. Perhaps for example if the Time Difference is less than a Threshold Time (e.g., one second), then a grip event between the two paired pressure sensors 16 and/or 716 may be considered valid, may be scored, and/or may be reported to the sport ball user. FIG. 14 illustrates an example measurement of a Time Difference for at least one pressure sensor pair.

In one or more techniques, perhaps for example if multiple pressure sensor pairs are active at the same time, then the mean value of one or more, or all, corresponding Time Differences may be used in scoring the grip event.

In one or more techniques, the shorter the time between paired pressure sensors activating may correspond to higher time component(s) of the grip score.

One or more techniques may perform score calculations and/or display one or more results. For example, in a score calculation, a grip score may be reported to a sport ball user after one or more, or each, grip event ranging from 0 to 1000, where 1000 may be a maximum grip score. The grip score scale of 0-1000 is an example scale for illustration, where other scales are contemplated herein. In an example calculation:

Grip Score=300*Grip Strength+400*Timing Score+300*Fraction of Paired Sensors

In one or more techniques, the Grip Strength may be determined by:

(Average Force Across Active Sensors)/(Maximum Sensor Force)

In one or more techniques, the Timing Score may be determined by:

(Threshold Time−Time Difference)/Threshold Time

In one or more techniques, the Fraction of Paired Sensors may be determined by:

(Number of Paired Active Sensors)/(Number of Unpaired Active Sensors)

In one or more techniques, the Grip Score may integrate strength, timing, and/or handling technique. In one or more techniques, strength, timing, and/or handling technique may be measured and/or displayed independently.

In one or more techniques, the weights for one or more, or each, component for any of the calculations described herein can be adjusted/tailored, as desired, for a particular target audience, for example. The weights for one or more, or each, component for any of the calculations described herein can be adjusted/tailored for individual athletes, for example by end users of any of the analysis described herein. In one or more techniques, one or more Grip Scores may be time stamped and/or saved for aggregate analysis and/or post-practice review.

Figure 15:
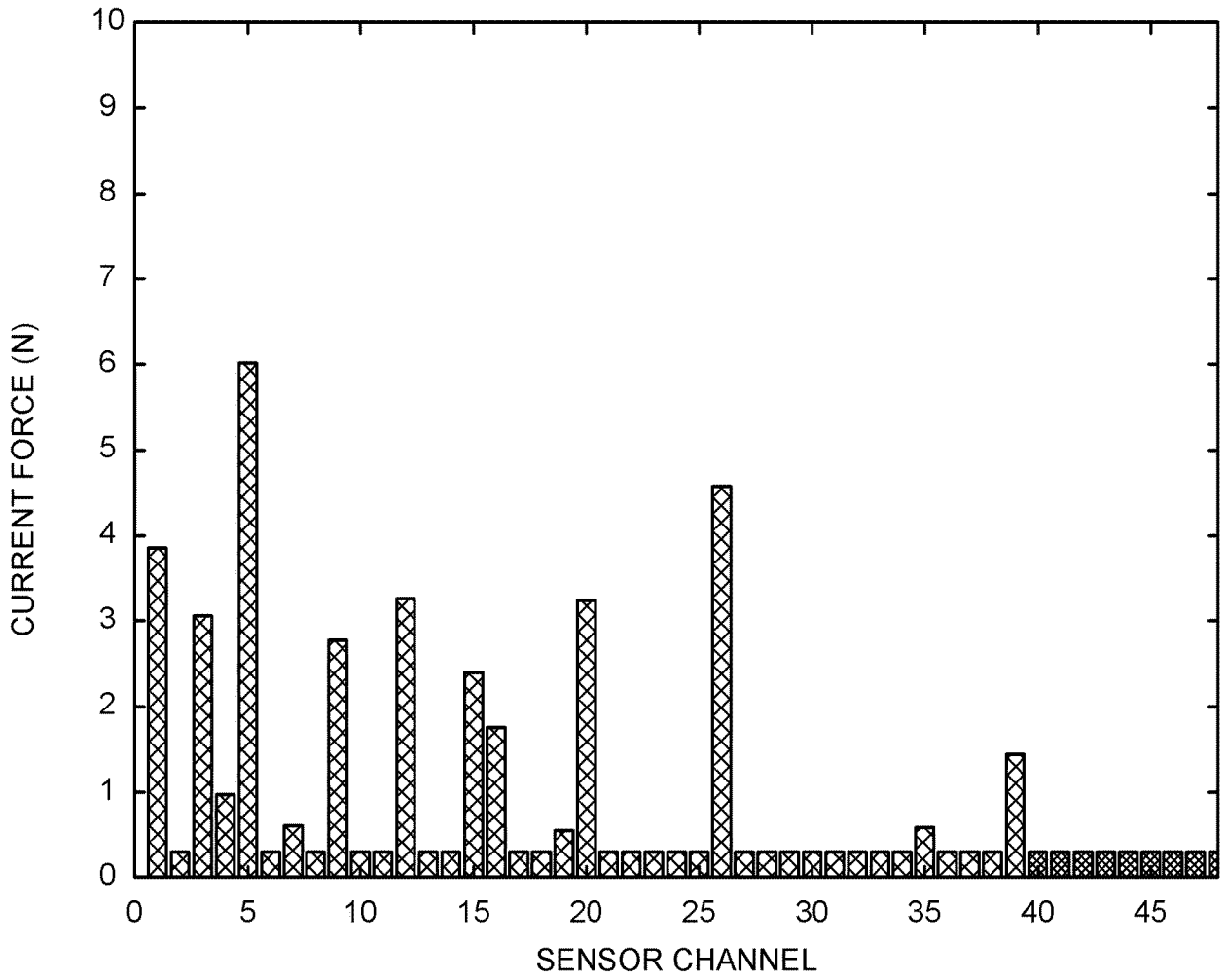
FIG. 15 is a graphical display of example pressure sensor force measurements for pressure sensors that may be disposed on a sport ball.

In one or more techniques, pressure sensor 16 and/or 716 channel output for any of the sport balls described herein may be measured and/or displayed. FIG. 15 illustrates an example of a display (e.g., real-time and/or historical) of pressure sensor channel (e.g., activation) output signals (e.g., measured forces) for one or more, or each, pressure sensor 16 and/or 716 for any of the sport balls described herein.

While the disclosure has been illustrated and described in detail in the drawings and foregoing description, the same is to be considered as illustrative and not restrictive in character, it being understood that only certain examples have been shown and described and that all changes and modifications that come within the spirit of the disclosure are desired to be protected.

The foregoing detailed description has set forth various examples of the systems, devices, and/or processes via examples and/or operational diagrams. Insofar as such block diagrams, and/or examples contain one or more functions and/or operations, those within the art will understand that one or more, or each, function and/or operation within such block diagrams, and/or examples can be implemented, individually and/or collectively, in any order, by a wide range of hardware, software, and/or firmware, or any combination thereof.

Although features and/or elements are described herein in particular combinations, one of ordinary skill in the art will appreciate that one or more, or each, feature and/or element can be used alone, or in any combination with the other features and/or elements, in any order. The methods described herein may be implemented in a computer program, software, and/or firmware incorporated in a computer-readable medium for execution by a computer or processor (e.g., computing device 104).

What is claimed is:

1. A sport ball device comprising:

an outer surface;

an inner space;

one or more sensors, each of the one or more sensors configured to generate one or more force values corresponding to pressure applied to the outer surface;

a processing module, the processing module configured at least to:

communicate with the one or more sensors; and at least one of: determine a grip event using the one or more force values, determine at least one handling value using the one or more force values, or transmit the one or more force values to a remote processing device; and at least one counterweight disposed proximate to the inner space, the at least one counterweight providing a counterweight effect to the processing module.

2. The device of claim 1, further comprising:

at least three counterweights disposed proximate to the inner space to provide a counterweight effect to at least the processing module.

3. The device of claim 1, wherein the inner space includes an air bladder.

4. The device of claim 1, wherein the one or more sensors are resistive force sensors.

5. The device of claim 1, wherein the sport ball is at least one of: a basketball, a soccer ball, or a football.

6. The device of claim 1, wherein the one or more sensors are disposed at, at least one of: on the outer surface, or within the outer surface.

7. The device of claim 1, wherein the outer surface has an external side and an internal side, the device further comprising:

a sensor layer, the sensor layer disposed adjacent to the internal side of the outer surface.

8. The device of claim 7, wherein the one or more sensors are disposed at, at least one of: on a surface of the sensor layer, or within the sensor or layer.

9. The device of claim 7, wherein sensor layer is comprised of the one or more sensors.

10. The device of claim 1, wherein the processing module is further configured to:

recognize that at least two of the one or more sensors are paired; and determine the grip event based, at least in part, on the one or more force values respectively generated by each of the at least two paired sensors.

11. The device of claim 10, wherein the at least two paired sensors are disposed on diametrically opposite positions relative to the sport ball device.

12. The device of claim 10, wherein the at least two paired sensors are disposed on relatively opposite positions relative to the sport ball device.

13. The device of claim 1, wherein the processing module is further configured to:

determine the at least one handling value corresponding to the pressure applied to the outer surface of the sport ball based, at least in part, on the one or more force values generated by at least one of the one or more sensors.

14. The device of claim 13, wherein the at least one handling value is a grip score.

15. The device of claim 10, wherein the at least two paired sensors include a first sensor and a second sensor, the at least one handling value includes a grip score, and the processing module is further configured to:

determine a timing difference between an activation of the first sensor and an activation of the second sensor; and determine the grip score based, at least in part, on the timing difference.

16. A method of evaluating a use of a sport ball, the sport ball having an outer surface, an inner space, a processing module, and at least one counterweight disposed proximate to the inner space, the at least one counterweight providing a counterweight effect to the processing module, the method comprising:

detecting, by the processing module, one or more force values produced by one or more sensors disposed on the sport ball, the one or more force values corresponding to pressure applied to the outer surface;

at least one of: determining, by the processing module, a grip event using the one or more force values, or determining, by the processing module, at least one handling value using the one or more force values; and transmitting at least one of: the grip event, the at least one handling value, or the one or more force values to a remote processing device.

17. The method of claim 16, further comprising:

recognizing, by the processing module, that at least two of the one or more sensors are paired; and determining, by the processing module, the grip event based, at least in part, on the one or more force values respectively generated by each of the at least two paired sensors.

18. The method of claim 17, wherein the at least two paired sensors include a first sensor and a second sensor, the at least one handling value includes a grip score, and the method further includes:

determining, by the processing module, a timing difference between an activation of the first sensor and an activation of the second sensor; and determining, by the processing module, the grip score based, at least in part, on the timing difference.

19. The method of claim 16, wherein the sport ball is at least one of: a basketball, a soccer ball, or a football.

20. The method of claim 16, wherein the at least one handling value corresponds to the pressure applied to the outer surface of the sport ball, and the method further comprises:

determining, by the processing module, the at least one handling value based, at least in part, on the one or more force values generated by at least one of the one or more sensors.

* * * * *